US009905972B2

(12) United States Patent
Lindkamp et al.

(10) Patent No.: US 9,905,972 B2
(45) Date of Patent: Feb. 27, 2018

(54) PLUG CONNECTOR HAVING CROSSTALK COMPENSATION

(71) Applicant: HARTING ELECTRONICS GMBH, Espelkamp (DE)

(72) Inventors: Marc Lindkamp, Luebbecke (DE); Michael Schulte, Cologne (DE)

(73) Assignee: HARTING Electronics GmbH (DE)

( * ) Notice: Subject to any disclaimer, the term of this patent is extended or adjusted under 35 U.S.C. 154(b) by 210 days.

(21) Appl. No.: 14/780,439

(22) PCT Filed: Jan. 23, 2014

(86) PCT No.: PCT/DE2014/100018
§ 371 (c)(1),
(2) Date: Sep. 25, 2015

(87) PCT Pub. No.: WO2014/154198
PCT Pub. Date: Oct. 2, 2014

(65) Prior Publication Data

US 2016/0056579 A1 Feb. 25, 2016

(30) Foreign Application Priority Data

Mar. 26, 2013 (DE) ..... 10 2013 103 069

(51) Int. Cl.
*H01R 13/6464* (2011.01)
*H01R 13/6466* (2011.01)
(Continued)

(52) U.S. Cl.
CPC ..... *H01R 13/6464* (2013.01); *H01R 13/6466* (2013.01); *H01R 24/64* (2013.01);
(Continued)

(58) Field of Classification Search
CPC ..... H01R 13/6461; H01R 13/6464; H01R 13/6666; H01R 13/6467; H01R 23/005;
(Continued)

(56) References Cited

U.S. PATENT DOCUMENTS 5,547,405 A 8/1996 Pinney et al. ..... 439/894
5,716,237 A * 2/1998 Conorich ..... H01R 13/6464 439/660

(Continued)

FOREIGN PATENT DOCUMENTS

CN 1245985 A 3/2000
CN 1305652 A 7/2001

(Continued)

OTHER PUBLICATIONS

WO 9952182, 63 pages, Oct. 14, 1999.*

(Continued)

*Primary Examiner* — Tho D Ta
*Assistant Examiner* — Travis Chambers
(74) *Attorney, Agent, or Firm* — Hayes Soloway PC

(57) ABSTRACT

A plug-in connector that can be manufactured using MID technology, which nevertheless ensures good crosstalk compensation and thus a high data transmission rate has two assembled contact carrier parts with contacts are disposed between these contact carrier parts. A separate, electrically conductive compensation coating may be provided in each contact carrier part, each having a connection surface for producing an electrically conductive connection to an associated contact. Each of the electrically conductive compensation coatings has at least one coupling surface for a targeted capacitive coupling with one or more further contacts. Between each coupling surface and the associated contact, an insulating film or part of an insulating film is provided, which acts as a dielectric and a spacer. By selec- (Continued)

Figure 1A:
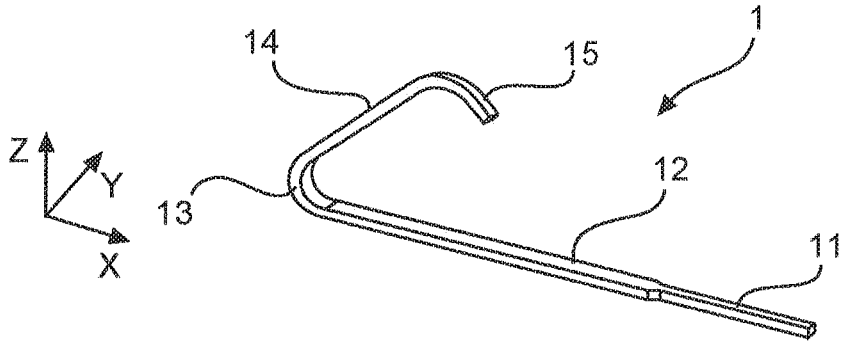

tion of the contacts to be coupled and the capacitance of the coupling, good compensation of undesired crosstalk can thus be achieved in a simple manner.

44 Claims, 12 Drawing Sheets

(51) Int. Cl.
*H01R 24/64* (2011.01)
*H01R 13/6467* (2011.01)
*H01R 107/00* (2006.01)

(52) U.S. Cl.
CPC ..... *H01R 13/6467* (2013.01); *H01R 2107/00* (2013.01); *Y10S 439/941* (2013.01)

(58) Field of Classification Search
CPC ..... H01R 24/64; H01R 2107/00; H04B 2201/709709; Y10S 439/941
USPC ..... 439/620.21, 676, 941
See application file for complete search history.

(56) References Cited

U.S. PATENT DOCUMENTS 5,791,943 A * 8/1998 Lo ..... H01R 13/6397 439/491
6,042,427 A * 3/2000 Adriaenssens ..... H01R 13/6464 439/676
6,371,793 B1 4/2002 Doorhy et al. ..... 439/404
6,520,808 B2 * 2/2003 Forbes ..... H01R 13/6464 439/676
6,769,937 B1 * 8/2004 Roberts ..... H01R 24/64 439/676
6,786,775 B1 * 9/2004 Hanrahan ..... H01R 13/502 439/676
7,708,603 B1 * 5/2010 Little ..... H01R 13/6464 439/676
7,794,287 B1 * 9/2010 Harlan ..... H01R 24/64 439/676
7,850,492 B1 12/2010 Straka et al. ..... 439/676
7,857,667 B1 * 12/2010 Wang ..... H01R 13/6466 439/676
8,128,432 B2 * 3/2012 Jaouen ..... H01R 13/6464 439/620.01
8,157,598 B2 * 4/2012 Niitsu ..... H05K 3/32 439/620.22
8,425,255 B2 * 4/2013 Erickson ..... H01R 13/6464 439/620.22
2010/0041278 A1 2/2010 Bopp et al. ..... 439/676
2010/0317221 A1 12/2010 Lee et al.
2012/0088395 A1 4/2012 Feldner et al. ..... 439/435

FOREIGN PATENT DOCUMENTS

CN 101777717 A 7/2010
CN 102771017 A 11/2012
DE 69927451 7/2006 ..... H01R 13/33
DE 10 2013 103 295 11/2011 ..... H01R 24/00
EP 0 982 815 9/2005 ..... H01R 24/00
WO WO9952182 10/1999 ..... H01R 4/24

OTHER PUBLICATIONS

International Search Report issued in application No. PCT/DE2014/100018, dated Mar. 25, 2014 (6 pgs).
German Office Action issued in corresponding German Patent Appln. No. 10 2013 103 069.6 dated Nov. 21, 2013 (7 pgs).
International Search Report issued in corresponding PCT Patent Appln. No. PCT/DE2014/100018 dated Mar. 25, 2015 (4 pgs).

* cited by examiner

PLUG CONNECTOR HAVING CROSSTALK COMPENSATION

The invention relates to a plug-in connector according to the preamble of independent patent claim 1.

Such plug-in connectors, for example RJ45 connector sockets, are used for transmitting high frequency data signals.

PRIOR ART

Document DE69927451T2 discloses a modular electrical plug-in connector with reduced crosstalk. This document discloses the use of a printed circuit board that can be equipped with first conductors and second conductors. Between the second conductors, for example insulation displacement terminations provided on the cable terminal, and the first conductors, e.g. plug-in contacts, the printed circuit board has conducting paths on the outer layers. On an inner layer, the printed circuit board has capacitors for capacitively coupling the conductive paths in a targeted manner, in order to influence in this way the crosstalk behaviour of the plug-in connector. This means that the targeted capacitive coupling takes place in the area of the conductive paths.

Document WO9952182A1 discloses a modular electrical connector (male) and a corresponding cable connector assembly. In this case, channels for receiving the cable are provided in the cable connection area. These channels may have an electrically conductive material, e.g. a copper foil or an electrically conductive coating, in particular a metallised plastic, in order to produce corresponding capacitive couplings in the channels. This means that the targeted capacitive coupling for compensating crosstalk takes place in the area of the cables.

Document U.S. Pat. No. 7,850,492 discloses a communication plug-in connector with improved crosstalk compensation. In addition to the use of a rigid printed circuit board, this document discloses the use of a flexible printed circuit board, wherein both printed circuit boards include structures for compensating crosstalk. The flexible printed circuit board is provided on the otherwise free-standing contact ends of the resilient contacts. It has conductive paths on both sides. On one side, each conductive path provided thereon comes into contact with one of the contacts. However, on this side, there are fewer conductive paths than contacts so that some contacts are not electrically connected to a printed circuit board. By means of vias to further conductive paths that are located on the other side of the flexible printed circuit board, capacitive couplings with other contacts are produced, wherein the flexible printed circuit board acts as a spacer and a dielectric. The contacts are combined to form in each case symmetrically connected contact pairs 1-2, 3-6, 4-5 and 7-8. Subsequently, for example the especially strong crosstalk between the contact pairs 3-6 and 4-5 is compensated by capacitively coupling the contact 3 with the contact 5. By using a flexible printed circuit board directly on the contact ends, a particularly high degree of accuracy is achieved without restricting the functionality of the resilient contacts.

What is of disadvantage in this prior art is that during the manufacturing process of this plug-in connector, it is very complex to position, with the required accuracy, in the final position and to ultimately fix and, if necessary, connect in an electrically conductive manner, e.g. by soldering, the flexible printed circuit board needed in this process, to the ends of the otherwise free-standing contacts. On the other hand it has been shown by means of measurements and simulations that crosstalk compensation can be adjusted the more accurately the closer the targeted capacitive coupling is located on the free-standing ends of the contacts.

OBJECT OF THE INVENTION

It is therefore the object of the invention to provide a plug-in connector that can on the one hand be produced with minimum effort but at the same time ensures good data transmission, in particular in accordance with Connector Category $6_A$ ($CAT6_A$) according to the ISO/IEC 11801 specification.

This object is achieved with a plug-in connector of the kind mentioned at the beginning by means of the features of the characterising part of independent patent claim 1.

Advantageous embodiments of the invention are indicated in the dependent claims.

The plug-in connector is a plug-in connector that is comparatively simple to manufacture, in particular an RJ45 socket that preferably has eight contacts. These contacts are advantageously equipped with four symmetrical signal pairs. In this connection, the following specified pairwise combination of the contacts numbered in the contact-side order is established: $1^{st}$ pair: contacts 1-2; $2^{nd}$ pair: contacts 3-6; $3^{rd}$ pair: contacts 4-5; $4^{th}$ pair: contacts 7-8. In order to counteract the particularly detrimental crosstalk between the contacts 2-3, 6-7, 3-4 and 5-6, which naturally occurs as a result, such a plug-in connector has a coupling matrix that is suitable for capacitively coupling for example contact 3 with contacts 1, 5 and 7, i.e. with the further odd-numbered contacts, in order to thus significantly reduce this crosstalk. Alternatively or additionally it is possible, in a comparative manner for reasons of symmetry, to capacitively couple also contact 6 with the further even-numbered contacts, namely contacts 2, 4 and 8, in order to compensate said crosstalk.

Compared to the prior art, the invention has, inter alia, the following essential advantages: on the one hand, the contact carrier of a plug-in connector according to the invention can be manufactured with comparatively little effort using for example the so-called "MID" (Moulded Interconnected Device) technology, in particular the so-called "LDS" (Laser Direct Structuring) method or, depending on the particular design, also the so-called "2C" (two component) method, and can realise in this way the capacitive couplings necessary for crosstalk compensation in the contact carrier and thus comparatively close to the contact areas of the contacts. What is of particular advantage here is that as a result of this, the necessity of using a flexible printed circuit board with the corresponding connecting and fixing effort is avoided. On the other hand, the capacitive coupling through the contact carrier, as demonstrated by measurements and simulations, ensures at the same time a very good fine adjustment of the capacitive crosstalk attenuation and as a result a high data transmission rate. In particular, the transmission characteristics of the plug-in connector meet the requirements of $CAT6_A$.

In this connection, the at least one compensation coating is advantageously electrically connected to one of the contacts and is capacitively coupled with at least one other contact. The electrically conductive connection between the compensation coating and the one contact may be produced for example by directly pressing this contact, for example as a result of the shape of the insulation body and in particular as a result of the assembly of two correspondingly shaped insulating body halves, directly against the compensation coating. Further, the compensation coating may have a specified distance from the at least one other contact with which it is capacitively coupled, which is smaller than 100 μm, preferably equal to or smaller than 50 μm and in particular equal to or smaller than 25 μm and of course in any case greater than 0 μm, and it is, inter alia, this small distance that ensures the capacitive coupling to a sufficient degree. This specified distance may be realised by means of an electrically insulating layer which consists for example in an insulating varnish, but advantageously in an electrically insulating film, which electrically insulating layer is provided between the compensation coating and the at least one other contact, with which it is capacitively coupled. Advantageously, this insulating layer, in particular the film, not only acts as a spacer between the compensation coating and the respective contact, but also as a dielectric that correspondingly enhances the capacitive coupling.

In an advantageous embodiment, the contact carrier may be implemented in one piece. In this case, for example the 2C method may be used as an MID process. However, also in this one-piece design, for example the LDS method may be used for coating, namely by way of providing the contact carrier with corresponding recesses through which a laser can carry out the corresponding activations of the LDS-suitable substrate from which the contact carrier is made, before the electrically conductive coating patterned thereby is at least partially covered by the inserted contacts. This one-piece design of the contact carrier has the advantage that it allows a particularly precise guiding of the contacts. This is ultimately also of benefit for the accuracy of the decoupling.

In another advantageous embodiment, the contact carrier is made up of two contact carrier parts that can be assembled, for example a first and a second contact carrier part, and is therefore designed in two pieces. This is advantageous in order to introduce the capacitive couplings as well as the contacts into the contact carrier with minimum effort and to simplify assembly. Subsequently, the contacts may be disposed between the two contact carrier parts and may be held in channels of the contact carrier parts that are in each case provided for this purpose. To this end, the contact carrier parts may each have a connection surface and may be assembled with these connection surfaces and fixed to each other, for example glued or welded. To this end, one channel is provided in each connection surface of each contact carrier part for each contact. Such a channel may have for example two edges, each in the form of a collar, between which the associated contact may be inserted in a form-locking manner. During the assembly of the contact carrier parts, the connection surfaces thereof are arranged against each other, with their associated channels coming to lie directly on top of each other, and the contacts are disposed in the associated channels of each contact carrier part and are in particular fixed therein by the edges thereof and/or by adjacent webs in a form-locking and frictional manner. An advantage of the two-piece design of the contact carrier consists in the comparatively simple manufacturing, namely the simplification of the process of laser structuring of the, as a result, initially open connection surfaces of the individual contact carrier parts as well as the subsequent simplified assembly of the contact carrier with the contacts.

On each contact carrier part, a separate electrically conductive compensation coating may further be provided that extends over a plurality of channels of the respective contact carrier part. Each contact carrier part may have webs with the height d. Some of the channels may be provided on such webs. In particular, each contact carrier part may have eight channels corresponding to the preferred number of contacts. Of these, for example four channels may be located on webs. The webs may be alternatingly spread over the channels so that for example every other channel, i.e. for example each even-numbered or each, odd-numbered channel, is located on a web. However, it is also possible that some contacts cross one another between the assembled contact carrier parts, i.e. in the contact carrier, i.e. that they change their channels within the contact carrier. This is accounted for in this design by way of a slightly more complex shape of the contacts and of the webs, and this shape is selected such that the contacts can carry out the channel change without touching each other.

The two contact carrier parts may be designed, with regard to their webs, substantially complementary relative to each other so that during the assembly of the two contact carrier parts, one web of one contact carrier part will always engage in a web-free area of the other contact carrier part.

Advantageously, the contacts have a connection region, a holding region, a curved region, a contact region and preferably an end region. Apart from this, however, they may be implemented differently.

The holding regions of the contacts may be located between the two contact carrier parts. Thus, the contacts are held by the contact carrier in the holding regions thereof. Thus, one reason for the good adjustability of the compensation may be seen in the fact that compensation is correspondingly carried out by the compensation coating on the holding regions and thus substantially closer to the contact regions of the contact than this would be the case if it was carried out on the connection regions or even before the latter on cables connected thereto or on corresponding conductive paths. The holding regions of the various contacts may be located, varying from one channel to the next, for example in an alternating manner, in two different levels, namely a first level and a second level, which two levels have a distance d from each other, i.e. the first contact is located in the first channel and its holding region is located in the second level; the second contact is located in the second channel and the holding region thereof is located in the second level.

The connection regions of the contacts may be located outside of the contact carriers. As a result, these connection regions may be shaped in such a way that they are located, independently of the course of the holding regions and independently of the design of the contact carrier, in each case in the desired level that is provided for the connection thereof, for example on a printed circuit board.

In an advantageous embodiment, a region of the coherent electrically conductive compensation coating can be regarded as a connection surface. This connection surface is provided for being connected to one of the contacts, preferably in the holding region thereof, in an electrically conductive manner. Further, at least one further region of the compensation coating may be regarded as a coupling surface and at least one further region may serve as a conductive path. The at least one conductive path may then connect the at least one coupling surface directly or indirectly, i.e. via one or more other coupling surfaces, to the connection surface in an electrically conductive manner. Each coupling surface is intended for capacitive coupling with one of the further contacts. This is advantageous because it allows to capacitively couple the contact that is connected to the connection surface in an electrically conductive manner, in an electrically conductive manner to e.g. at least one further contact via the conductive compensation coating, namely the respective conductive path. By way of an advantageous selection and dimensioning of this capacitive coupling, any undesired crosstalk may in this way be particularly effectively counteracted because this capacitive coupling is preferably carried out on the holding regions of the contacts.

Further, each contact carrier part may have a first recess in at least one web, preferably in a plurality of webs, which respectively connects the two channels adjacent to the web. On each contact carrier half, in each case at least one coherent electrically conductive compensation coating may be provided, and one part of the respective electrically conductive compensation coating may extend through these first recesses in the form of said conductive path. If the webs are for example spread over the even-numbered channels, then for example the compensation coating may extend over the odd-numbered channels, due to the fact that the conductive path thereof extends through said first recesses in the webs of the even-numbered channels. The odd-numbered channels are for example provided for receiving the contacts 1, 3, 5 and 7. As a result, as has already been mentioned by way of example, contact 3 may be capacitively coupled in the second contact carrier part with contacts 1, 5 and 7, so that such an arrangement corresponds to said coupling matrix that is particularly advantageous for crosstalk compensation, and this arrangement is therefore also of particular advantage. Additionally or alternatively thereto, also the contact 6 may be capacitively coupled with the contacts 2, 4 and 8 in the first contact carrier part. The latter can be realised by virtue of the fact that the second contact carrier part is substantially complementary to the first contact carrier part and is thus coated analogously to the first contact carrier part so that a mirror-symmetrical decoupling matrix can be obtained in the contact carrier as a result of the final assembly of the two contact carrier parts with their connection surfaces by virtue of the two associated compensation coatings.

Between each coupling surface and the associated contact, an electrically insulating layer, in particular a film formed from an electrically insulating material, or part of such a film may be provided which thus acts as a dielectric and a spacer between the respective contact and the associated coupling surface. Moreover, an integral film may be provided in each case for each contact carrier part. In order to allow an insertion of such an integral foil in a form-locking manner, the two contact carrier parts may in each case have second recesses between the channels and their adjacent channels, and the films may be implemented to have for example an E shape. Further, also a slight indentation may be provided, the depth of which preferably corresponds to the thickness of the film, and the shape of which preferably corresponds to the shape of the film, and into which the film can thus be inserted in a form-locking manner.

In an advantageous embodiment, the plug-in connector has, as has already been mentioned, eight contacts. The contacts are electrically conductive and are made from a resilient material. They have, as has already been mentioned, at least one connection region, a holding region, a curved region and a contact region as well as preferably an end region. In the bending region, they are bent in such a way that an angle exists between the connection region and the contact region, the angle being smaller than 90° and greater than 0° and is in particular between 30° and 60°. Each of the contacts may be held in its holding region in the contact carrier, in particular between the two contact carrier parts. The curved region and the connection region may be located outside of the contact carrier.

The holding regions of the contacts may be provided in the contact carrier in each case in one of the two mentioned levels parallel to each other in the associated channels, and the two levels have a distance d from each other. This has the advantage that at least two contacts can cross one another without touching each other within the contact carrier, so that their positions may be interchanged in the order of the contact regions in respect of their positions in the order of their connection regions. As a result of this crossing, some rough crosstalk compensation may already be advantageously realised. In order to ensure at the same time an alternating arrangement of the connection regions with regard to the two levels, in the case of the two crossing contacts, the connection regions may be offset in relation to the holding regions again by the distance d. In this case, the connection region of such a contact in one of the levels and the holding region of the same contact is always in the respectively other level. However, their connection regions remain alternating and therefore match the usual connection profile of a specified printed circuit board.

In an advantageous embodiment, each of the two contact carrier parts which can be assembled with each other, has an inner side. This has the advantage that the compensation coating can be applied therein for example using an LDS (Laser Direct Structuring) technology, i.e. an MID (Moulded Interconnect Device) technology. By inserting the contacts and assembling the contact carrier parts, the above-described capacitive coupling may be realised. The contacts may be arranged between the contact carrier parts in the channels provided for this purpose. In order to avoid an electric contacting of the contacts with the coupling surface on the coupling regions thereof, it is further advantageous to provide for each contact carrier part at least one film that can advantageously be inserted in an interlocking manner in several channels and that covers the compensation coating in the required places, i.e. at least on the coupling surfaces, in order to avoid an undesired electric contact with the corresponding contacts. For an exact positioning of the film, as has already been mentioned, the corresponding indentation may be provided, into which the film can be inserted in a form-locking manner. This film has a thickness that is equal to or smaller than 100 μm preferably equal to or smaller than 50 μm, in particular equal to or smaller than 25 μm. In addition to the electrical insulation, its use on the coupling surfaces also has the advantage that it acts as a dielectric and a spacer so that the capacitance of the respective capacitive coupling can be adjusted, inter alia, via the material and the thickness thereof.

Further, the plug-in connector in the completely assembled condition, which in addition advantageously has a shielding housing, can be mounted with the connection regions of its contacts on a rigid printed circuit board. As a result, also other compensation structures may additionally be provided, e.g. in the form of conductive paths, on the connection side of the rigid printed circuit board, via which additionally also the connection regions are capacitively coupled in a targeted manner in order to initially achieve a rough compensate of any undesired crosstalk. To this end, as has already been mentioned, also the holding regions of two contacts may cross one another within the contact carrier. Thus, a rough targeted capacitive coupling may be carried out prior to the compensation, but cannot be adjusted to a sufficient accuracy. The capacitive coupling matrix described above then additionally serves, as a result of the compensation coating, as fine tuning in order to ensure the accuracy of the capacitive couplings for reducing crosstalk and thus for achieving high data rates. Only in this way it becomes possible to achieve the targeted high data rates.

EMBODIMENT EXAMPLE

Figure 7:
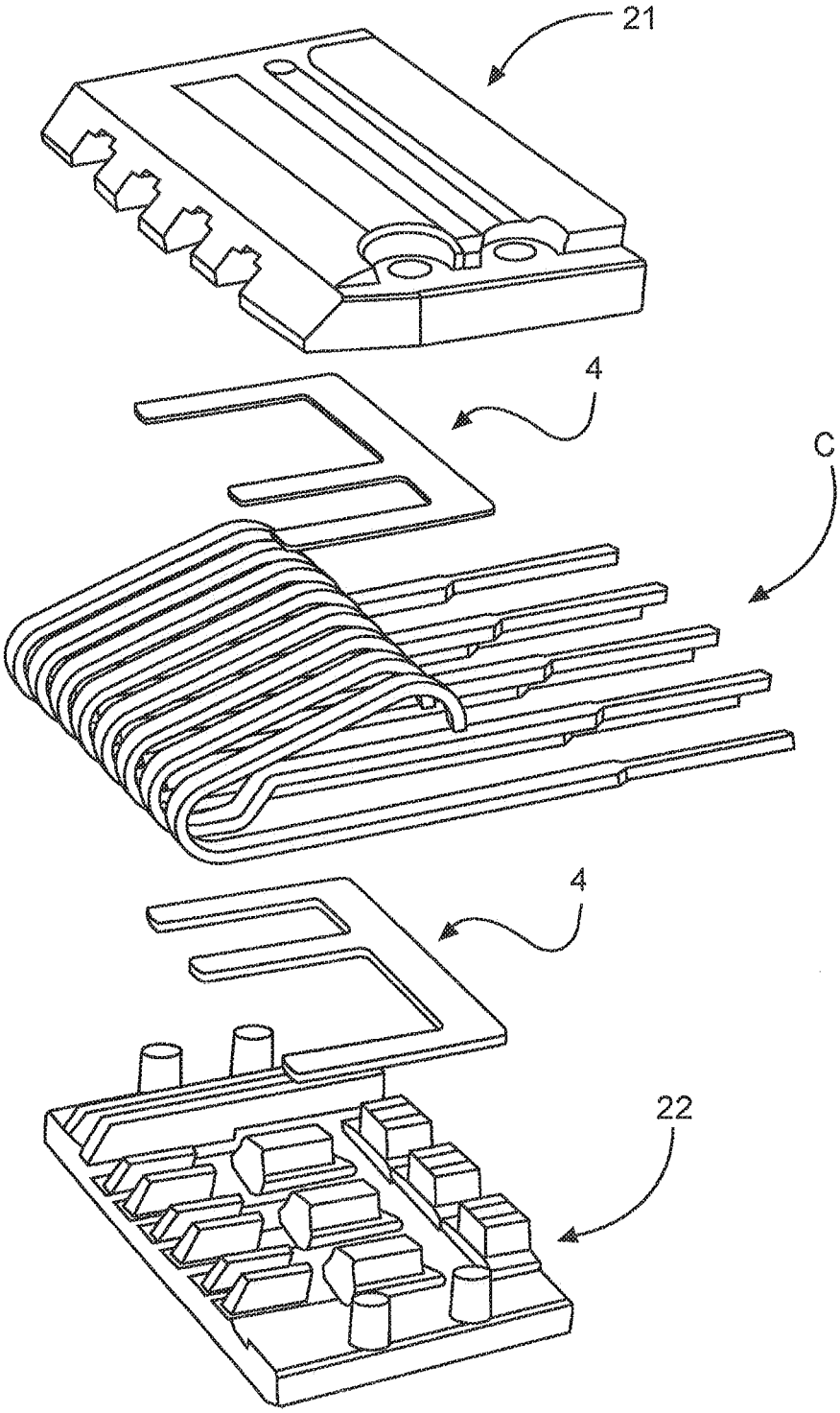

An embodiment example of the invention is shown in the drawings and will be explained in more detail below, wherein:

FIGS. 1 *a,b,c,d* show four contacts in different implementations;

FIGS. 2 *a,b* show a group of in each case eight contacts in an uncrossed and a crossed arrangement;

FIGS. 3 *a,b* show a first contact carrier consisting of two associated contact carrier parts for receiving uncrossed contacts;

FIGS. 3 *c,d* show a second contact carrier consisting of two further contact carrier parts for receiving crossed contacts;

FIGS. 4 *a,b,c* show the first contact carrier consisting of two associated contact carrier parts with first compensation coatings and in each case with a first film that has not yet been inserted;

FIGS. 4 *d,e,f* show the second contact carrier consisting of two associated contact carrier parts with second compensation coatings and in each case with a second film that has not yet been inserted;

FIGS. 5 *a,b* show the arrangements of FIGS. 4 *a, b, c* with the inserted film;

FIGS. 5 *c,d* show the arrangements from FIGS. 4 *d, e, f* with the inserted film;

FIGS. 6 *a,b* show two different contact carrier parts in each case with the associated crossed and uncrossed contacts and with the compensation coating of the second plug-in connector part;

FIG. 7 shows a contact carrier with uncrossed contacts in an exploded view;

FIGS. 8 *a,b* show the two assembled contact carriers with the associated inserted crossed and uncrossed contacts;

FIG. 9 *a* shows a finish-mounted plug-in connector in the housing on a first side of the printed circuit board;

FIG. 9 *b* shows the second side of the printed circuit board with compensation structures.

FIGS. 1*a*, 1*b*, 1*c* and 1*d* illustrate the principal forms of various contacts 1, 1', 1", 1'". All the contacts 1, 1', 1", 1'" are designed in one piece, are made from an electrically conductive resilient material and each has a connection region 11, 11', 11", 11'", followed by a holding region 12, 12', 12", 12'", followed by a curved region 13, 13', 13", 13'", followed by a contact region 14, 14', 14", 14'" and followed by an angled end region 15, 15', 15", 15'". The connection region 11, 11', 11", 11'" is delimited from the holding region 12, 12', 12", 12'" on account of the fact that it is narrower.

FIG. 1*a* shows a straight contact 1. Its holding region 12 constitutes a linear extension of the connection region 11. The holding region 12 and the connection region 11 extend in the X direction in a first level E1 which, for reasons of clarity, is not shown in the drawing.

Figure 1B:
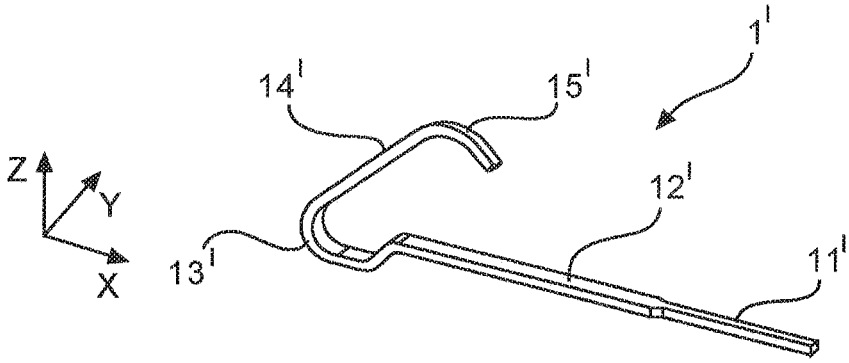

FIG. 1*b* shows an offset contact 1'. It differs, in its principal design, from the straight contact 1 essentially in that both the connection region 11' and the holding region 12' are offset from each other in a positive Z direction by the distance d, i.e. are located in a second level E2 instead of the first level E1, with the first level E1 and the second level E2 extending parallel to the plane defined by axes X and Y (hereinafter "XY level") and having a distance d from each other. The first level E2 is not shown either in the drawing for reasons of clarity.

Figure 1C:
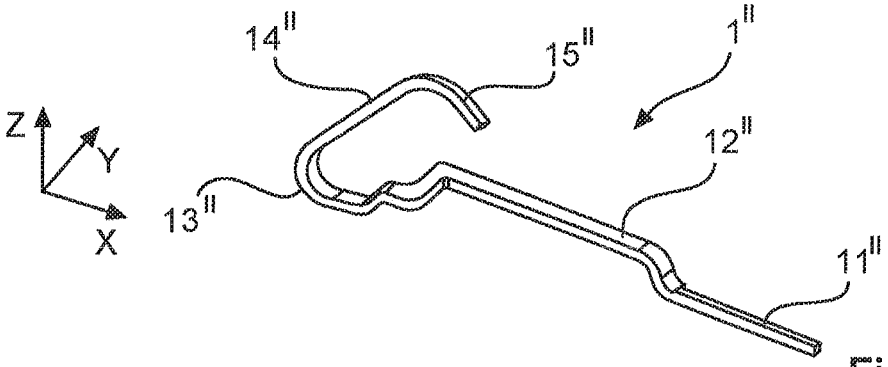

FIG. 1*c* shows a bridging contact 1". It differs in its principal design from the offset contact 1' in that the holding region 12" and the connection region 11" are additionally provided with an offset in the positive Y direction in respect of the curved region and the contact region 14", and in that the connection region 11" is again offset by the distance d in the negative Z direction in respect of the holding region 12", so that the connection region 11" is again located in the first level E1.

Figure 1D:
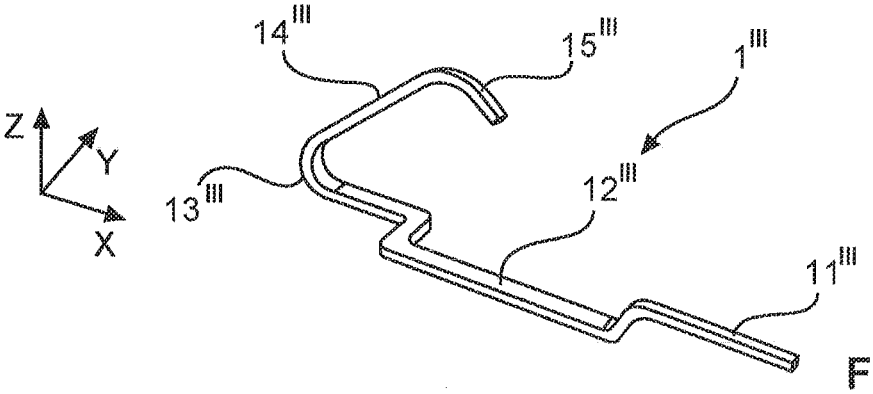

FIG. 1*d* shows an angled contact 1'". It differs from the straight contact 1 in that its holding region 12'" and its connection region 11'" are together offset in the negative Y direction, and in that further the holding region 12'" is provided in the first level E1, whereas the connection 11'" is provided in the second level E2 with an offset in the positive Z direction. The two levels E1 and E2 are not shown for reasons of clarity both in this and in the other views.

Figure 2A:
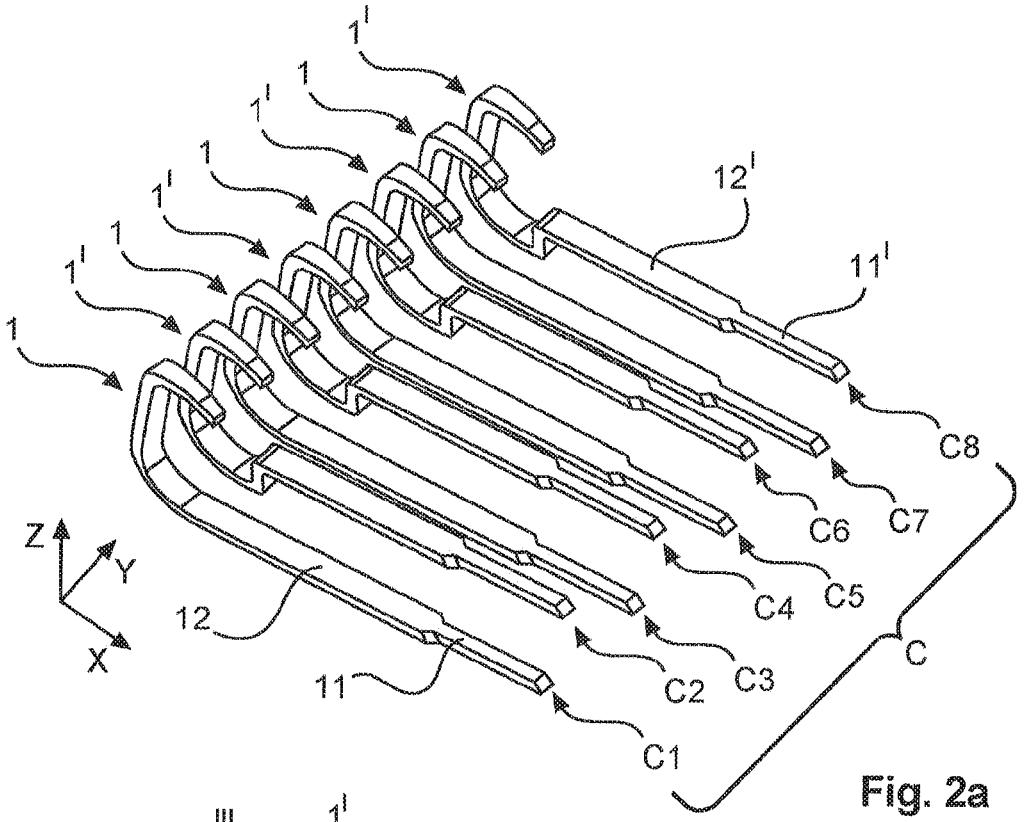

FIG. 2*a* shows an arrangement consisting of four straight contacts 1 and four offset contacts 1" of the plug-in connector in a perspective view. In order to enhance comprehensibility, the eight contacts C are arranged in a free-standing manner in their final position relative to each other. In this connection, in each case a straight contact 1 and an offset contact 1' are arranged in an alternating order. The contacts C are numbered in the order of their connection regions 11, 11' with the reference signs C1, C2, C3, C4, C5, C6, C7, C8.

The connection regions 11 and the holding regions 12 of the straight contacts 1 are commonly provided in the first level E1. The connection regions 11' and the holding regions 12' of the offset contacts 1' are provided in the second level E2, i.e. in the positive Z direction offset by the distance d relative to those of the straight contacts 1. All of the contacts C are orientated parallel to each other. Such an arrangement will be referred to below as contacts that are "arranged in a non-crossed manner" or "arranged in an uncrossed manner", because none of the associated contacts C cross one another.

Figure 2B:
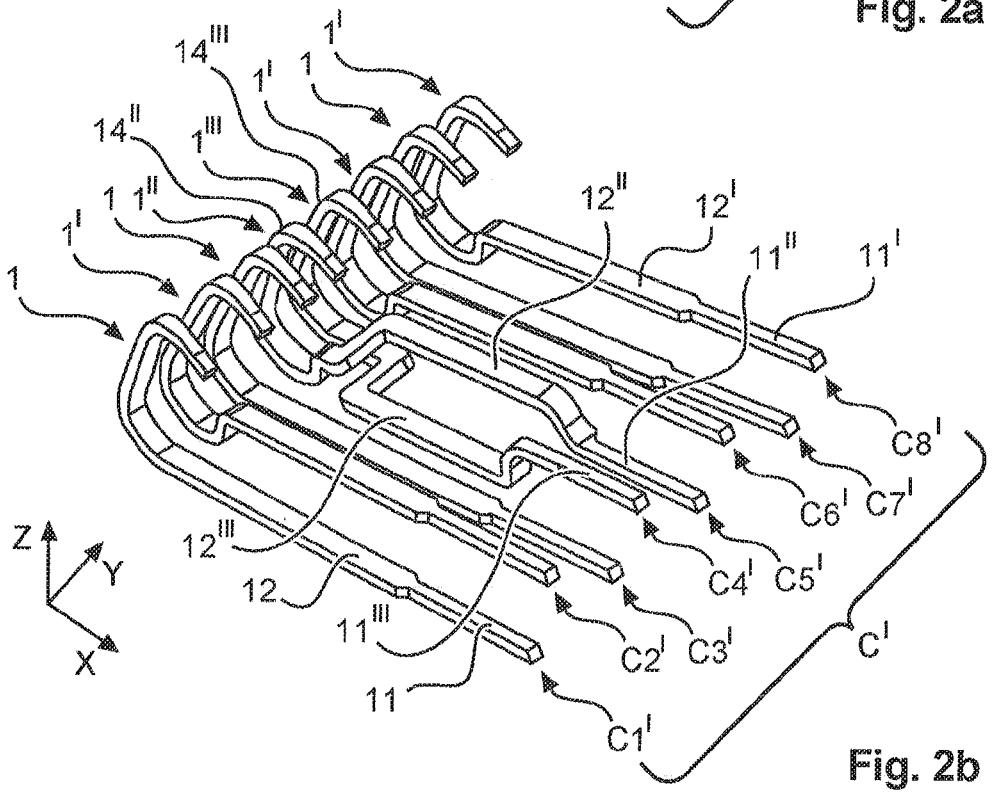

FIG. 2*b* shows an arrangement consisting of the following contacts C' numbered with C1', C2', C3', C4', C5', C6', C7', C8' in the order of their connection regions, wherein:

C1'—consists of a straight contact 1,
C2'—consists of an offset contact 1',
C3'—consists of a straight contact 1,
C4'—consists of an angled contact 1'",
C5'—consists of a bridging contact 1",
C6'—consists of an offset contact 1',
C7'—consists of a straight contact 1, and
C8'—consists of an offset contact, wherein the connection regions 11, 11', 11", 11'" thereof are arranged parallel to each other and next to each other in the order in which they are listed above. Such an arrangement will be referred to below as "contacts arranged in a crossed manner" because it has at least two contacts C4', C5' that cross one another on account of the fact that they are implemented in the form of an angled contact 1'" and a bridging contact 1". As a result, the positions of their connection regions 11", 11'" are interchanged with each other in respect of the positions of the associated contact regions 14", 14'".

Figure 3A:
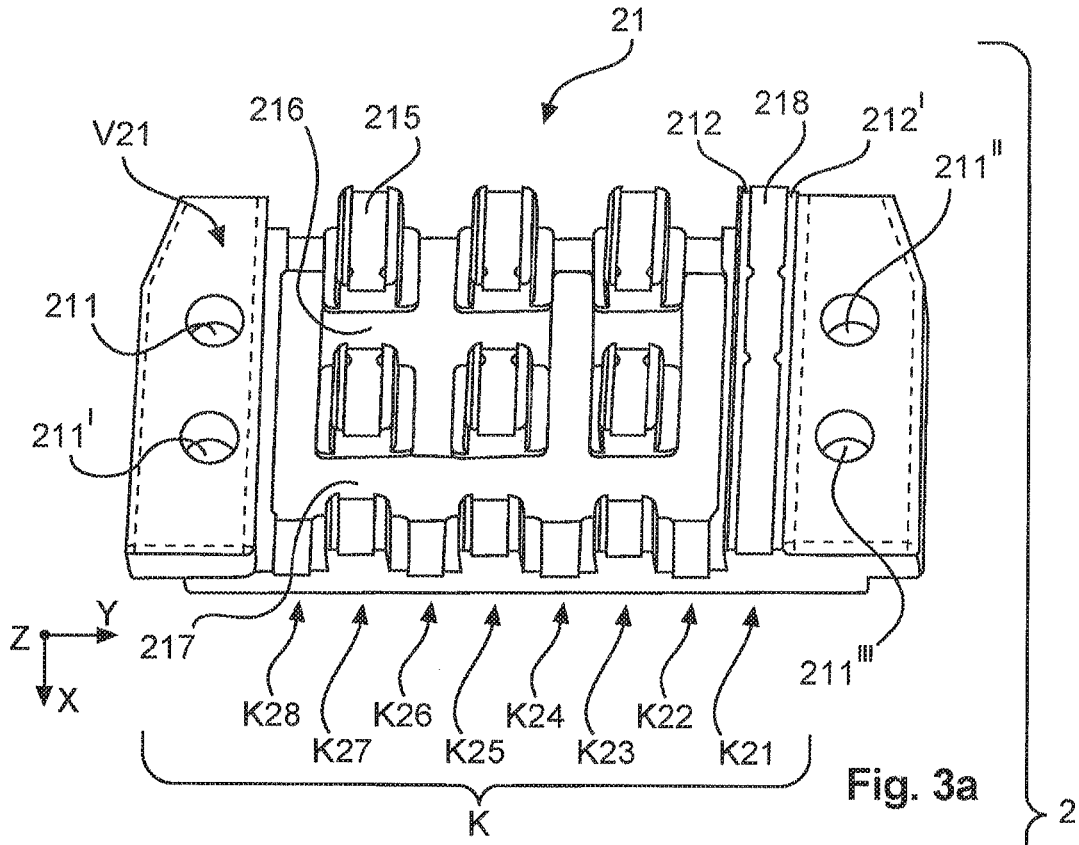
Figure 3B:
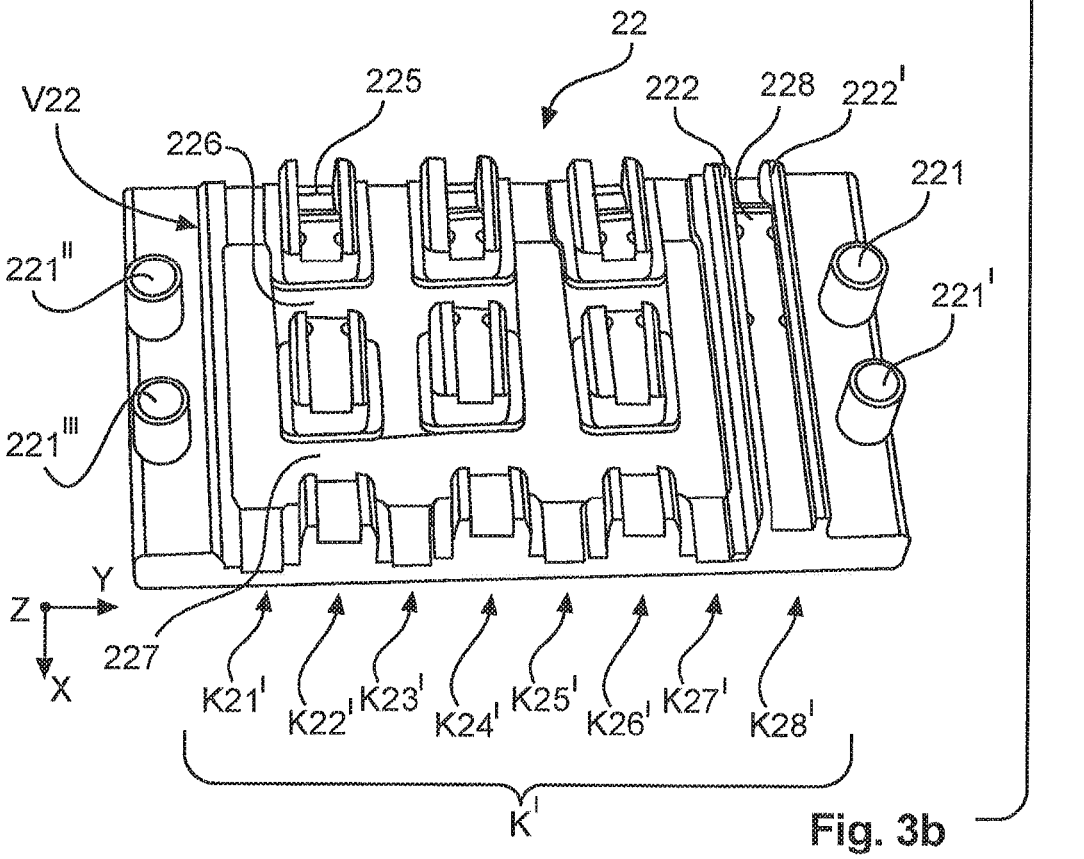

FIGS. 3*a* and 3*b* show a first contact carrier 2 consisting of a first contact carrier part 21 and a second contact carrier part 22 in a top view of their respective connection surfaces V21, V22. The contact carrier 2 is designed to receive an arrangement of uncrossed, i.e. straight contacts 1 and offset contacts 1' in an alternating order as shown in FIG. 2*a*. These two contact carrier parts 21, 22 are intended for being assembled, upon insertion of the contacts C, with their connection surfaces V21, V22.

To this end, the first contact carrier part 21 has first fastening means, namely in particular four fastening recesses 211, 211', 211", 211'", which are intended for cooperating with second fastening means, in particular fastening spigots 221, 221', 221", 221'" of the second contact carrier part 22. In particular, when assembling the two contact carrier parts 21, 22, the first contact carrier part is orientated in such a way that the first fastening spigot 221 of the first contact carrier part 21 is inserted into the fastening recess 211 of the second contact carrier part 22, the second fastening spigot 221' of the first contact carrier part 21 is inserted into the second fastening recess 211' of the second contact carrier part 22, the third fastening spigot 221" of the first contact carrier part 21 is inserted into the third fastening recess 211" of the second contact carrier part 22, and the fourth fastening spigot 221'" of the first contact carrier part 21 is inserted into the fourth fastening recess 211'" of the second contact carrier part 22.

Further, each of these two contact carrier parts 21, 22 has eight parallel channels K, K'. The channels K of the first contact carrier part 21 are numbered, on the connection side, with a view to the associated contact side from the right to the left, with the reference numerals K21, K22, K23, K24, K25, K26, K27, K28. The corresponding channels K' of the second contact carrier part 22 are correspondingly numbered, on the connection side, with a view to the associated contact side, from the left to the right, with the reference signs K21', K22', K23', K24', K25', K26', K27', K28'. This means, for the final assembly of these two contact carrier parts 21, 22, the first contact carrier part 21 is, as described above with regard to the fastening means, attached to the second contact carrier part 22 rotated in such a way that the channels with the same number, i.e. channels K21 and K21' as well as the channels K22 and K22', etc., come to lie on top of each other and together form the channels of the first contact carrier 2, in order to fix the corresponding contacts C therein.

The even-numbered channels K22, K22', K24, K24', K26, K26', K28, K28' are each provided for receiving an offset contact 1'. To this end, the even-numbered channels K22, K22', K24, K24', K26, K26', K28, K28' are offset from each other by a distance d in the Z direction in respect of the odd-numbered channels K21, K21', K23, K23', K25, K25', K27, K27'. To this end, webs 225, 228 of the height d are provided in the second contact carrier part 22 in the even-numbered channels K22', K24', K26', K28', although not all of the webs have been provided with a reference sign. In this connection, the web 228 is implemented to be continuous in the channel K28', i.e. is not interrupted by a recess. In channel K22', the web 225, as well as two further webs in channels K24' and K26', is interrupted by a first recess 226 and by a second recess 227. These two recesses have been provided with exemplary reference signs. Comparable recesses also appear in other webs, without each having been provided with a reference sign. Analogously, the first contact carrier part 21 in the first channel K21 also has a continuous web 218 with two collars 212, 212' as well as a web interrupted by two recesses 216, 217.

In the first contact carrier part 21, corresponding webs are provided in the odd-numbered channels K21, K23, K25, K27 and are in part interrupted by recesses 316, 317, 326, 327.

When assembling the two contact carrier parts 21, 22, therefore, in each case one channel that has a web, K21, K22', K23, K24', K25, K26', K27, K28', is provided in a channel that doesn't have a web, K21', K22, K23', K24, K25', K26, K27', K28. Thus, during assembly, each web of one contact carrier part 21, 22 is provided in a web-free region of the respectively other contact carrier part 22, 21. Further, each channel has on the two edges thereof in each case a collar so that the contacts 1, 1' can be inserted in a form-locking manner with their holding regions 12, 12' between these collars at least in certain regions. For example, channel K28' has in each case a collar 222, 222' on the two edges of its web 228, and channel K21 has in each case a collar 212, 212 on the two edges of its web 228. For reasons of clarity, the further collars of the second and third contact carriers have not been provided with reference signs.

Also the channels that have no webs have such collars on its edges, which collars however are also interrupted, if required, by the first and second recesses 216, 217, 226, 227.

Figure 3C:
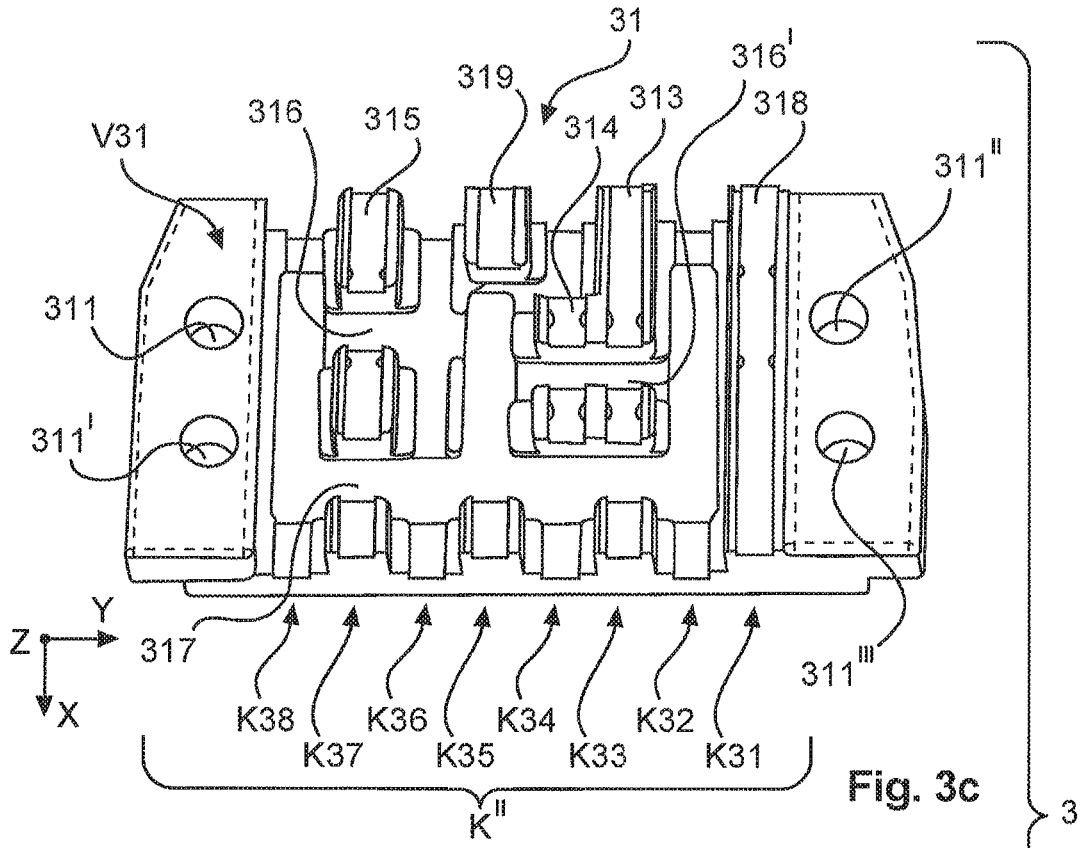
Figure 3D:
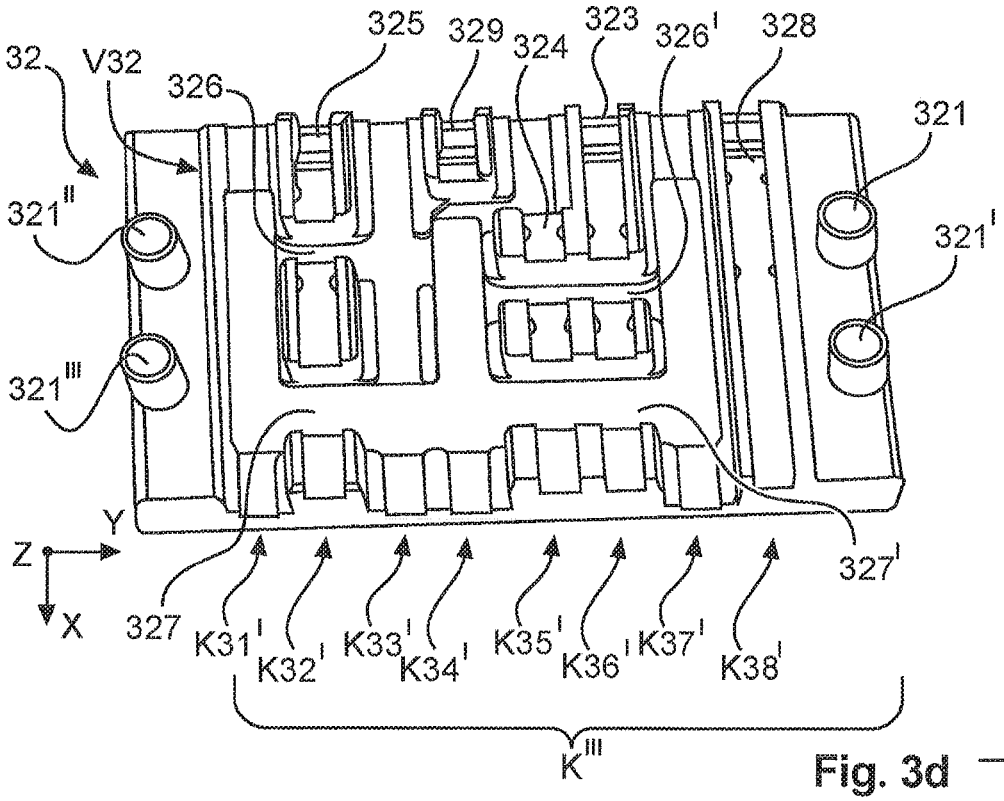

As an alternative, FIGS. 3*c* and 3*d* show a second contact carrier 3 consisting of a third contact carrier part 31 and a fourth contact carrier part 32 in a top view of the respective connection surface V31, V32 of the two contact carrier parts 31, 32. These two contact carrier parts 31, 32 are used for receiving contacts C' that are arranged in a crossed manner as shown in FIG. 2*b*, i.e. an arrangement of straight contacts 1, offset contacts 1', a bridging contact 1" and an angled contact 1'", wherein the bridging contact 1" and the angled contact 1'" cross one another.

The third contact carrier part 31 has first fastening means, namely in particular four fastening recesses 311, 311', 311", 311'", which are intended for interacting with second fastening means, in particular fastening spigots 321, 321', 321", 321'" of the fourth contact carrier part 32. In particular, during assembly of these two contact carrier parts 31, 32, the third contact carrier part is orientated in such a way that the first fastening spigot 321 of the third contact carrier part 31 is inserted into the first fastening recess 311 of the fourth contact carrier part 32, the second fastening spigot 321' of the third contact carrier part 31 is inserted into the second fastening recess 311' of the fourth contact carrier part 32, the third fastening spigot 321" of the third contact carrier part 31 is inserted into the third fastening recess 311" of the fourth contact carrier part 32, and the fourth fastening spigot 321'" of the third contact carrier part 31 is inserted into the fourth fastening recess 311'" of the fourth contact carrier part 32.

Further, each of the two contact carrier parts 31, 32 has eight channels. These eight channels K" of the third contact carrier part 31 are numbered, on the connection side, with a view to the associated contact side, in the order from right to left, with the reference signs K31, K32, K33, K34, K35, K36, K37, K38. The corresponding channels K'" of the second contact carrier part 32 are accordingly numbered, from left to right, with the reference numerals K31', K32', K33', K34', K35', K36', K37', K38', so that during the final assembly of these two contact carrier parts 31, 32, the even-numbered channels, i.e. channels K31 and K31' as well as channels K32 and K32', etc., come to lie on top of each other and together form a corresponding channel of the second contact carrier part 3, in order to fix the corresponding contacts C' therein.

The second, sixth and eighth channels K32, K32', K36, K36', K38, K38' are therefore respectively provided for receiving an offset contact 1'. To this end, in each case a web 325, 323, 328 with the height d is provided therein, wherein the two webs 323, 325 provided in the second and sixth channels K32', K36' are each interrupted by a first recess 326, 326' and a second recess 327, 327', respectively. By contrast, the web 328 is implemented to be continuous in the channel K38'.

In the third contact carrier part 31, no webs are provided in the corresponding channels K32, K36, K38. To this end, corresponding webs 315, 313, 318 are provided in the first, third and seventh channels K31, K33, K37, which in turn engage, during the assembly of the two contact carrier parts 31, 32, in the web-free channels K31', K33', K37' of the fourth contact carrier part 32.

The fourth and fifth channels K34, K34', K35, K35' are provided for receiving the crossing contacts 1", 1'". Correspondingly, these webs 319, 314, 329, 324 are not implemented to be continuous, but they are modified and adapted to the shape of the two crossing contacts 1", 1'" in such a way that the web 324 of the fifth channel K35' is additionally interrupted by a first recess 326' and a second recess 327'.

In particular, the webs 319, 314, 329, 324 of the fourth and fifth channels K34, K34', K35, K35' of the two contact carrier parts 31, 32 are designed to be substantially complementary to each other, i.e. during the assembly of both contact carrier parts 31, 32, a web of a contact carrier part 31, 32 engages in a web-free region of the respectively other contact carrier part 32, 31.

Further, collars are also provided along the edges of the channels in the fourth contact carrier part, which, for reasons of clarity, have not been provided with reference signs in the drawing.

Figure 4A:
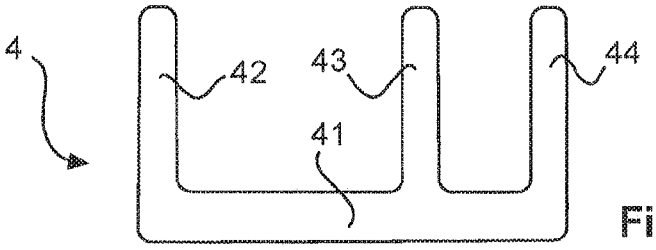
Figure 4B:
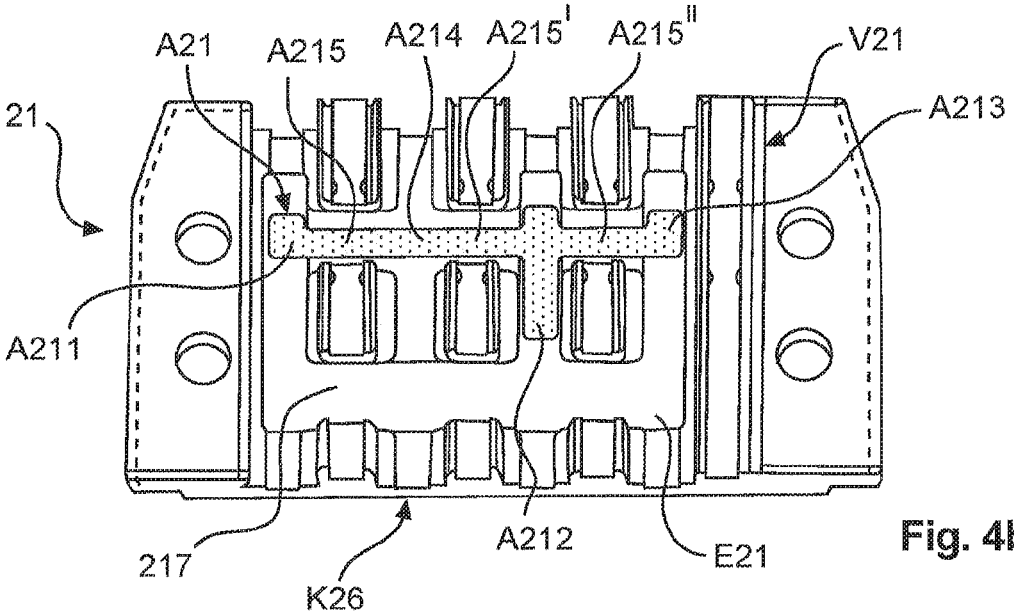
Figure 4C:
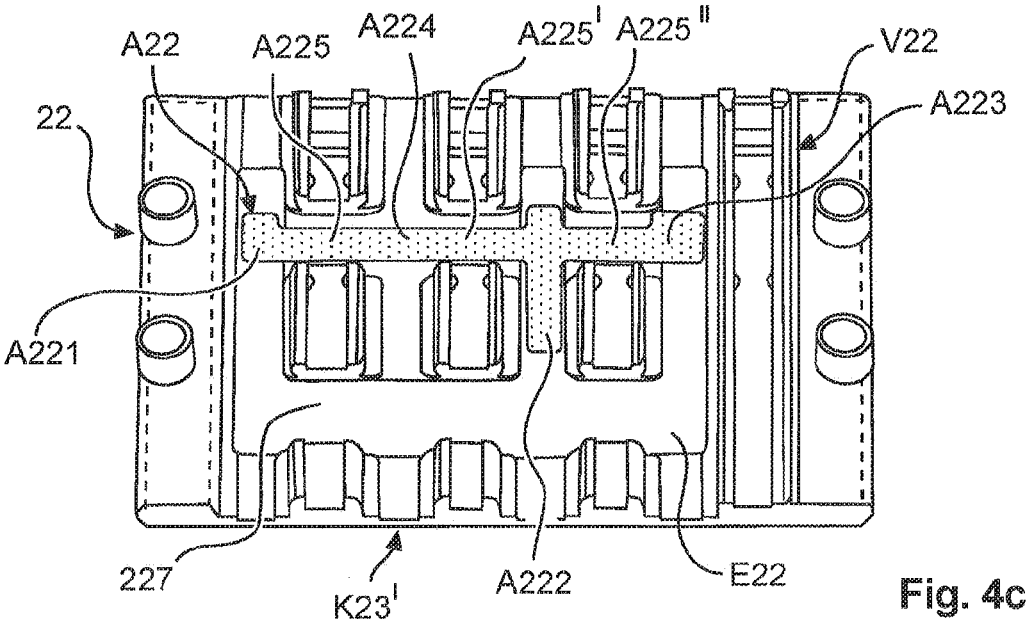

FIGS. 4*a*, 4*b* and 4*c* show the first and second contact carrier parts 21, 22 of the first contact carrier 2 in a top view of the respective connection surface thereof, as well as an associated first film 4 that is formed from an electrically insulating material, such a first film 4 being provided for each contact carrier part 21, 22. The first film 4 is formed to be E-shaped and has a transverse web 41 as well as three arms 42, 43, 44 parallel to each other which open therein at right angles.

The two contact carrier parts 21, 22 have, in addition to the features mentioned above, in each case a slight indentation E21, E22 with a depth that corresponds to the thickness of the first film, and with a shape that corresponds to the shape of the first film 4, as a result of which the first film 4 can be inserted into the respective indentation E21, E22 in a form-locking manner. It can also be seen from the illustration that the second recesses 217, 227 are used to enable the integral first film 4 to be inserted into the respective indentation E21, E22.

Further, the contact carrier parts 21, 22 each have a coherent, electrically conductive compensation coating A21, A22. These compensation coatings A21, A22 are applied to the respective connection surfaces and extend over several channels.

Each of the compensation coatings A21, A22 has conductive paths A215, A215', A215", A225, A225', A225". These conductive paths A215, A215', A215", A225, A225', A225" each extend through first recesses 216, 226 of the webs 215, 225 (cf. FIGS. 3 *a, b*). For reasons of clarity, the reference signs of the first recesses 216, 226 have not been added in this view.

Further, the compensation coatings A21, A22 each have coupling surfaces A211, A212, A213, A221, A222, A223, the geometrical extension of which is proportionate to the respectively targeted capacitance. Moreover, each compensation coating A21, A22 has a connection surface A214, A224. The respective connection surface A214, A224 is connected in an electrically conductive manner directly to the associated coupling surfaces A211, A212, A213, A221, A222, A223 via the conductive paths A215, A215', A215", A225, A225', A225", or indirectly, i.e. via another coupling surface A212, A222.

Each compensation coating A21, A22 has a connection surface A214, A224, which is intended for establishing an electrically conductive connection to a contact. These connection surfaces A214, A224 are provided in different channels, namely in the third channel K23' and in the sixth channel K26.

Figure 4D:
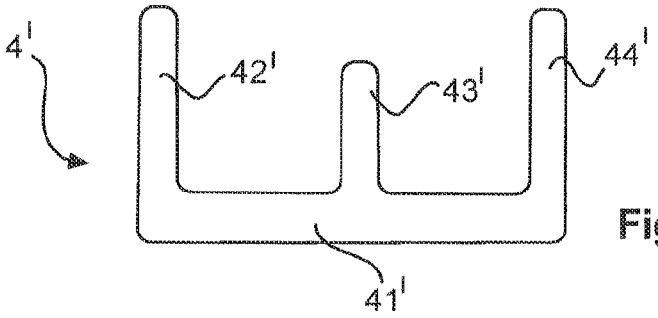
Figure 4E:
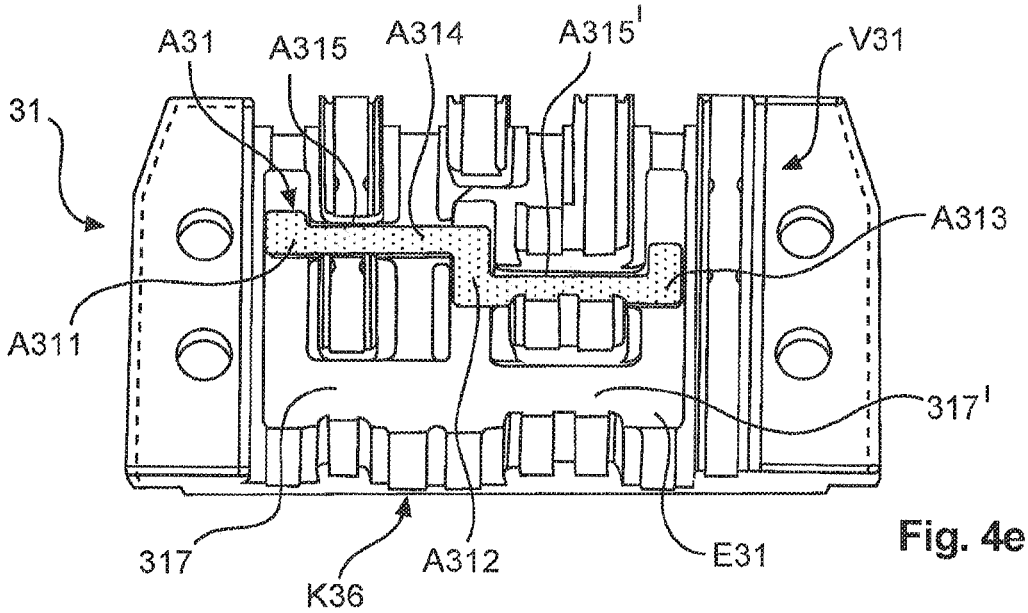
Figure 4F:
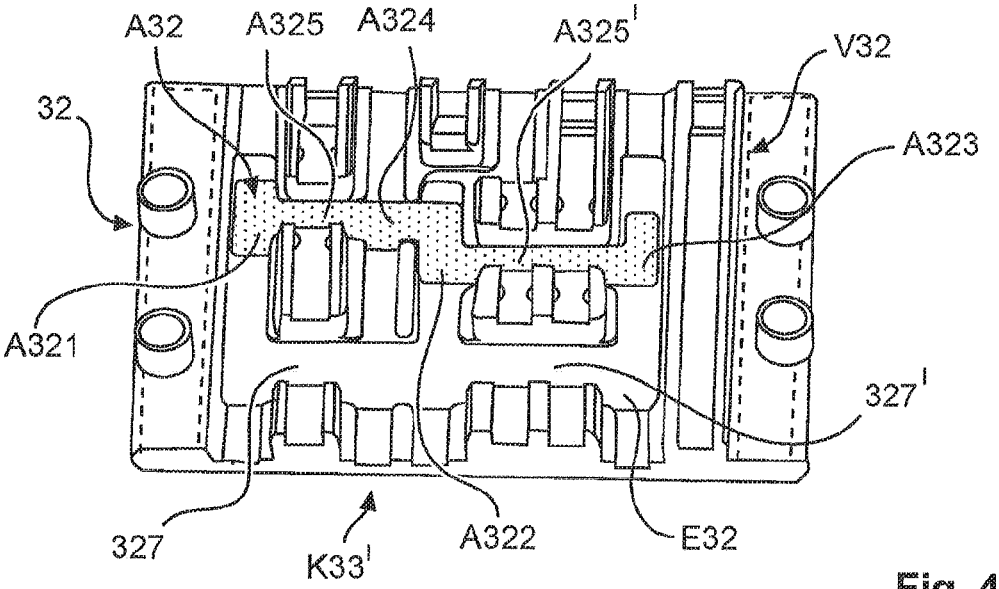
Figure 5A:
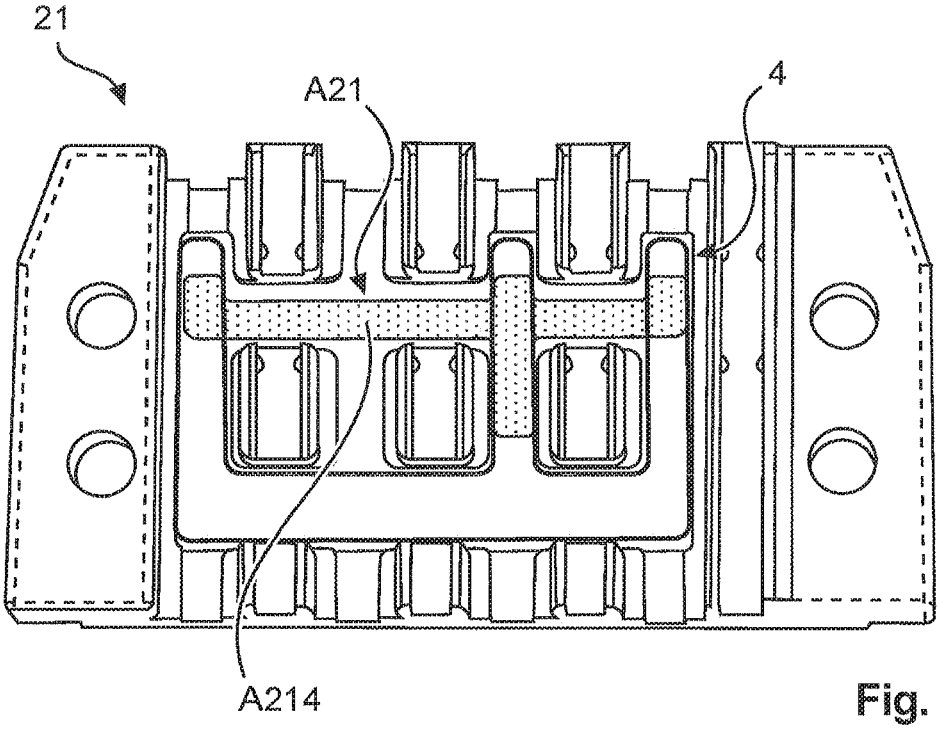
Figure 5B:
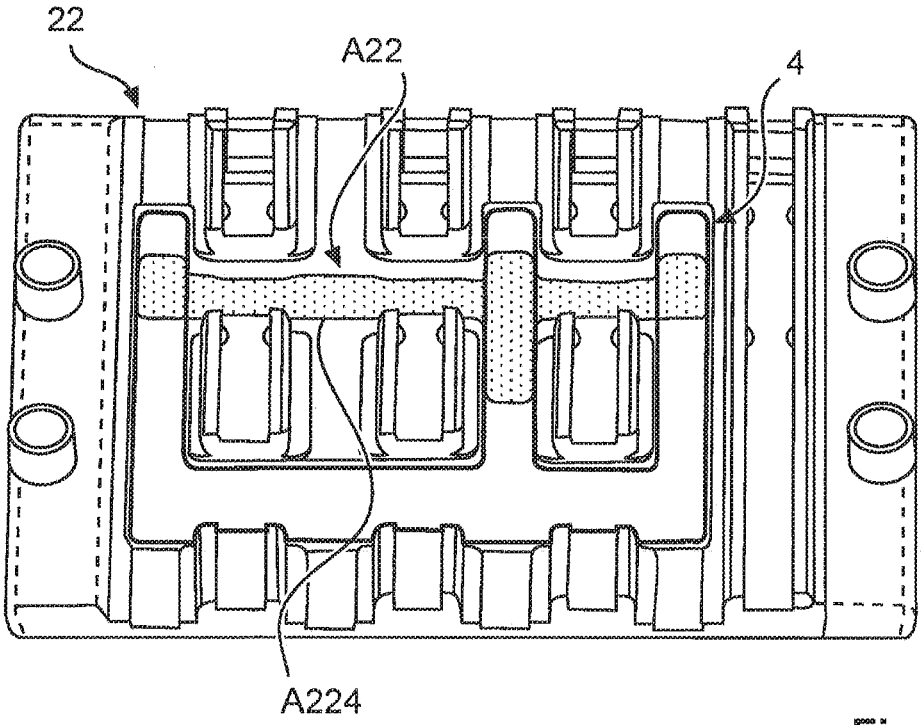
Figure 5C:
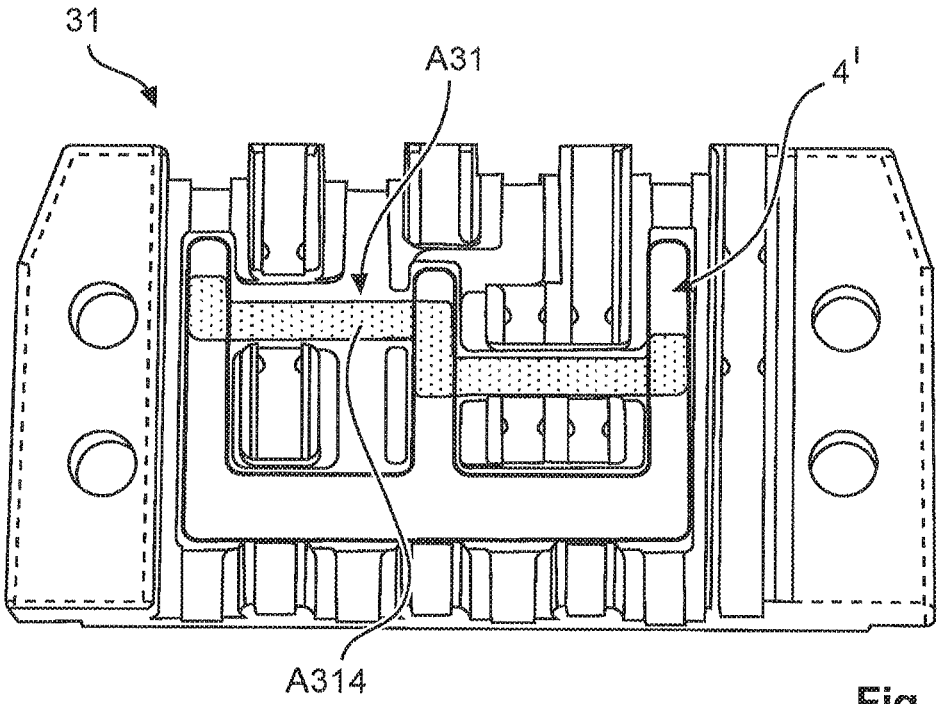
Figure 5D:
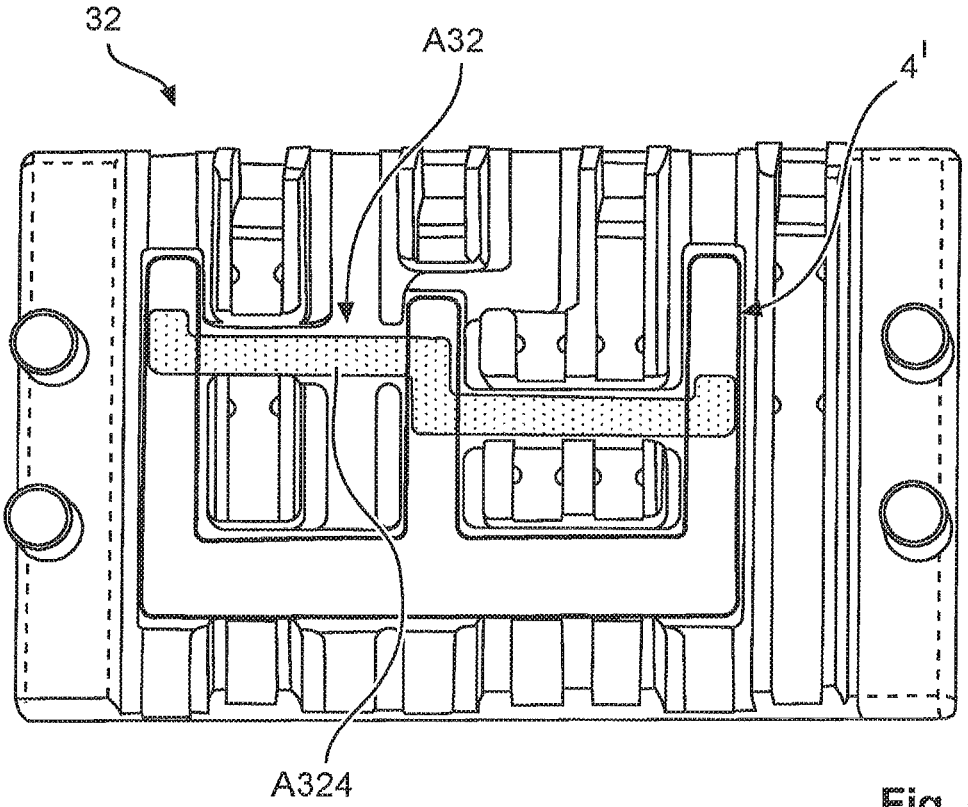

FIGS. 4*d*, 4*e* and 4*f* show the third and the fourth contact carrier parts 31, 32 which belong to the second contact carrier 3, as well as an associated second film 4' formed from an electrically insulating material, with such a second film 4' being provided for each contact carrier part 31, 32. The second film 4' is formed to be E-shaped and has a web 41' as well as three arms 42', 43', 44' that are parallel to each other and open therein at right angles. In this context, the second film differs from the first film 4 merely by the length and the position of the central arm 43'.

The two contact carrier parts 31, 32 are shown in FIG. 4*e* and FIG. 4*f* in a top view of their respective connection surface V31, V32. They have, in addition to the features mentioned above, in each case a slight indentation E31, E32 with a depth that corresponds to the film thickness, the shape of the respective indentation E31, E32 corresponding to the shape of the second film 4', and into which the second film 4' can be inserted in a form-locking manner. It can already be seen from this illustration that the second recesses 317, 317', 327, 327' are used for inserting the integral second film 4' into the respective indentations E31, E32.

Further, the two contact carrier parts 31, 32 of the second contact carrier 3 each have a coherent electrically conductive compensation coating A31, A32. These compensation coatings A31, A32 have been applied onto the respective compensation surfaces V31, V32 and extend over several channels.

The compensation coatings A31, A32 have conductive paths 315, 315', 315", 325, 325', 325". These conductive paths 315, 315', 315", 325, 325', 325" extend through first recesses 316, 316', 326, 326' of the respective webs 313, 314, 315, 323, 324, 325. Further, the compensation coatings A31, A32 have coupling surfaces A311, A312, A313, A321, A322, A323, the geometrical extension of which is proportionate to the respectively targeted capacitance. Moreover, each compensation coating A31, A32 has a connection surface A314, A324. The respective connection surface A314, A324 is connected in an electrically conductive manner directly to the associated coupling surfaces A311, A312, A313, A321, A322, A323 via conductive paths 315, 315', 315", 325, 325', 325", or indirectly, e.g. via another coupling surface A312, A322.

The connection surfaces A314, A324 of these two contact carrier parts 31, 32 are arranged in different channels, namely in the third channel K33' and in the sixth channel K36.

FIGS. 5 *a, b, c, d* show the first and second contact carrier parts 21, 22 as well as the third and fourth contact carrier parts 31, 32 with an inserted first film 4 and an inserted second film 4', respectively. From this view, it becomes clear from a comparison with FIGS. 4 *a, b, c, d, e, f* that the respective coupling surfaces A211, A212, A213, A221, 222, A223, A311, A312, A313, A321, A322, A323 are covered by the respective film 4, 4' and are thus, if necessary, insulated from the respective contact C1, C1', C5, C5', C7, C7', C2, C2', C4, C4', C8, C8' to be inserted and are spaced apart as defined via the film thickness. It further becomes clear that the second recesses are used for inserting the integral film 4, 4'. The transverse web 41, 41' of the inserted film 4, 4' extends through the second recesses 217, 227, 317, 327, 327'

(cf. FIGS. 3 *a, b, c, d* and FIGS. 4 *b, c, e, f*), with the respective connection surface A214, A224, A314, A324 not being covered by the film.

Figure 6A:
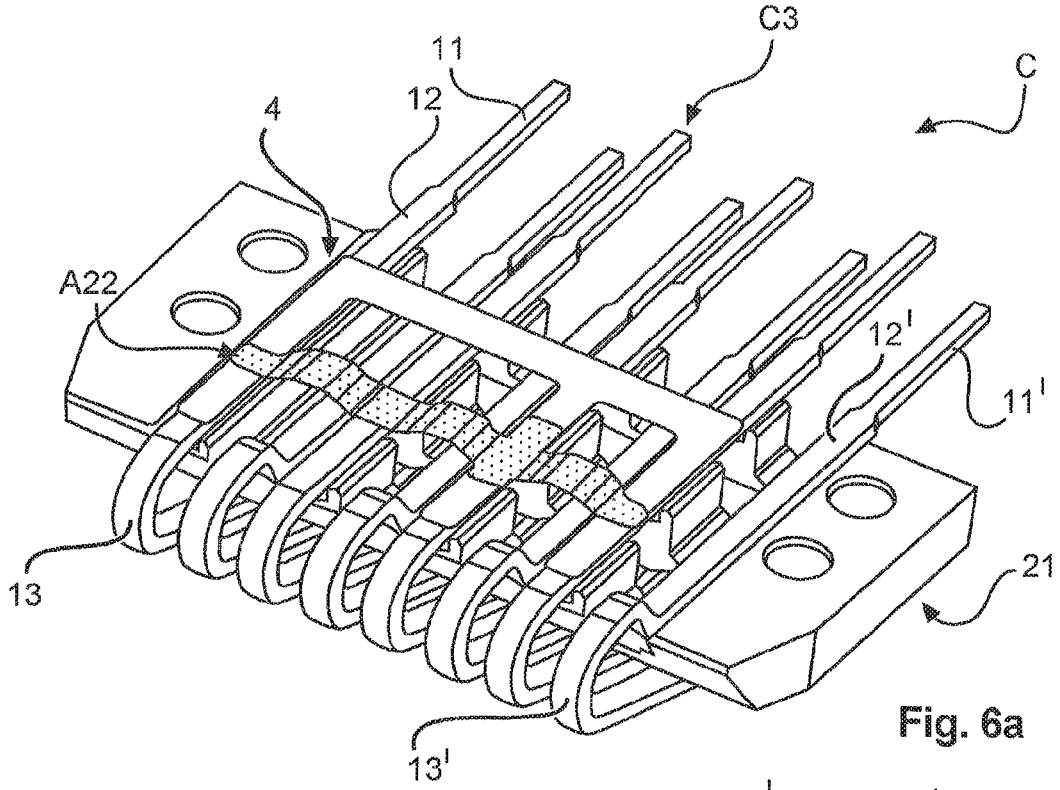
Figure 6B:
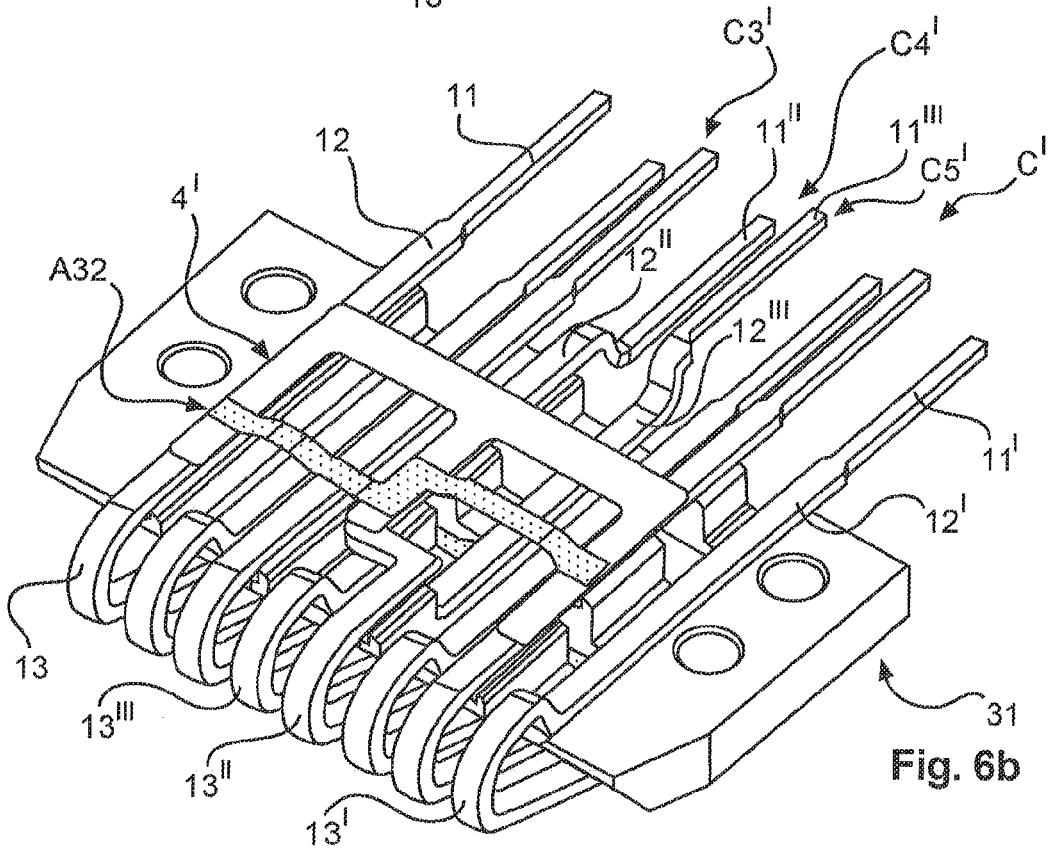

FIGS. 6*a* and 6*b* show the first and third contact carrier parts 21, 31 with the inserted, respectively associated, uncrossed or crossed arrangement of contacts C, C'. In addition, the respectively associated films 4, 4' and the compensation coatings A22, A32 of the second and fourth contact carrier parts 22, 32 are shown, although the respectively associated second and fourth contact carrier parts 22, 32 are not shown for reasons of clarity. The contact regions 11, 11', 11", 11'", the curved regions 13, 13', 13", 13'" and in particular the holding regions 12, 12', 12", 12'" of the contacts C, C' are very clearly visible in this view, whereas the associated contact regions 14, 14', 14", 14'" are covered by the respective first or third contact carrier part 21, 31. Further, it can be seen very well that the compensation coating is in each case in contact with the third contact C3, C3' and is capacitively coupled with the co-located curved regions 13, 13', 13", 13'" and contact regions 14, 14' 14", 14'" (not visible in this view) but not always with the co-located holding regions 12", 12'" and connection regions 11", 11'", because FIG. 6*b* shows crossed contacts C' and, by contrast, FIG. 6*a* shows uncrossed contacts C. As a result of the crossed arrangement, some rough crosstalk attenuation already occurs naturally between the crossing contacts C4', C5'. In the uncrossed arrangement, the corresponding coupling surface A222 is instead selected to be slightly larger, as a result of which a stronger coupling can occur for compensation.

FIG. 7 shows a contact carrier 2 with uncrossed contacts C in an exploded view. Correspondingly, the first contact carrier part 21 and the second contact carrier part 22 are shown. Between them, two associated films 4 are each arranged in a corresponding orientation. Between the films, the uncrossed contacts C are shown.

Figure 8A:
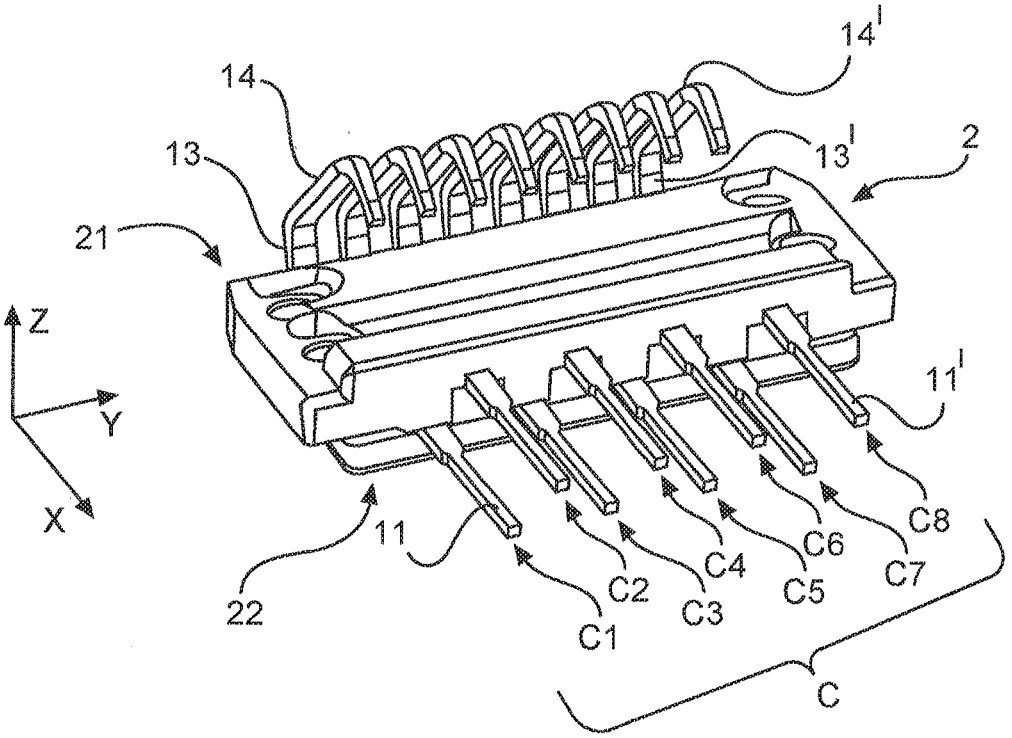
Figure 8B:
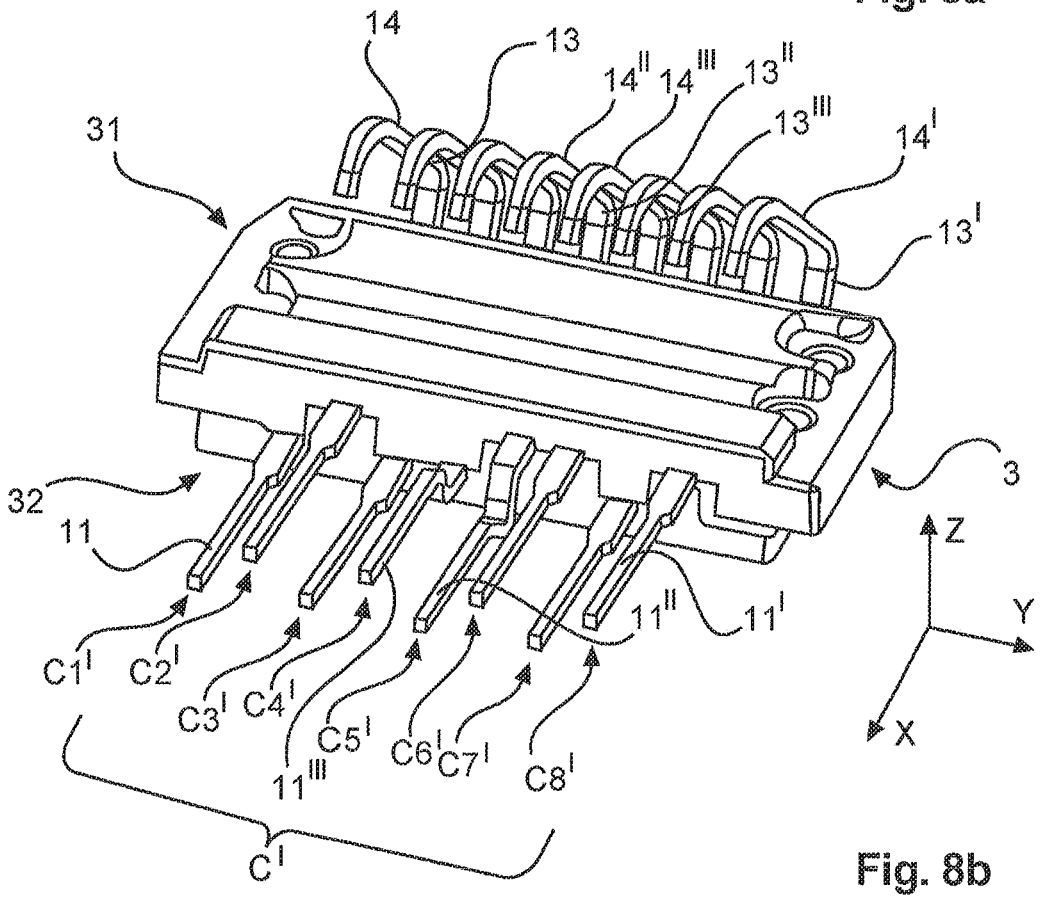

FIGS. 8*a* and 8*b* show the two different embodiments of assembled contact carriers 2, 3 with inserted contacts C, C', namely the first contact carrier 2 with the associated inserted uncrossed contact C and, as an alternative embodiment thereto, the second contact carrier 3 with the associated crossed contacts C'.

FIG. 8*a* shows a contact carrier 2 with the uncrossed arrangement of contacts C. This shows that both the connection regions 11, 11', 11', 11'" and the curved regions 13, 13', 13", 13'" are located outside of the contact carrier 2.

The contacts C are held between the first and second contact carrier parts 21, 22. Their connection regions 11, 11' extend alternatingly in the two levels E1 and E2. These levels E1, E2 are, as has already been mentioned, not shown in the drawing for reasons of clarity.

FIG. 8*b* shows a contact carrier 3 with the crossed arrangement of contacts C'. On the one hand this shows that the contacts C4' and C5' cross each other within the contact carrier 3. On the other hand it can also be seen that the connection regions 11, 11', 11", 11'" are provided outside of the contact carrier and are bent in such a way that they extend, in the order of their connection regions 11, 11', 11", 11'", alternatingly in the two levels E1 and E2 (not shown).

Figure 9A:
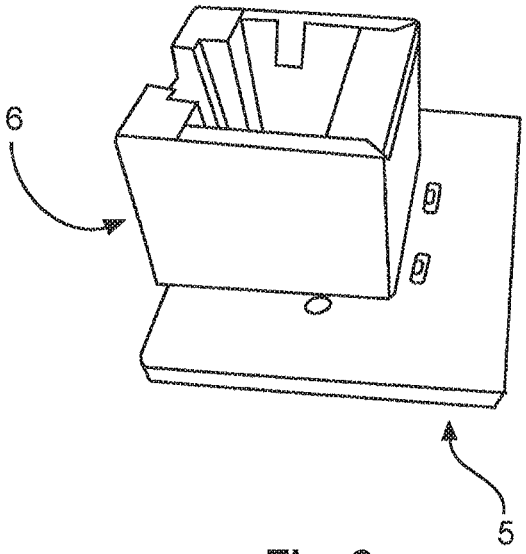

FIG. 9*a* shows a plug-in connector housing 6 that is mounted on a front side of a printed circuit board 5 and in which one of the contact carriers 2, 3 is provided. The connection regions 11, 11', 11", 11'" of the associated contacts C, C' are guided on or through the printed circuit board.

Figure 9B:
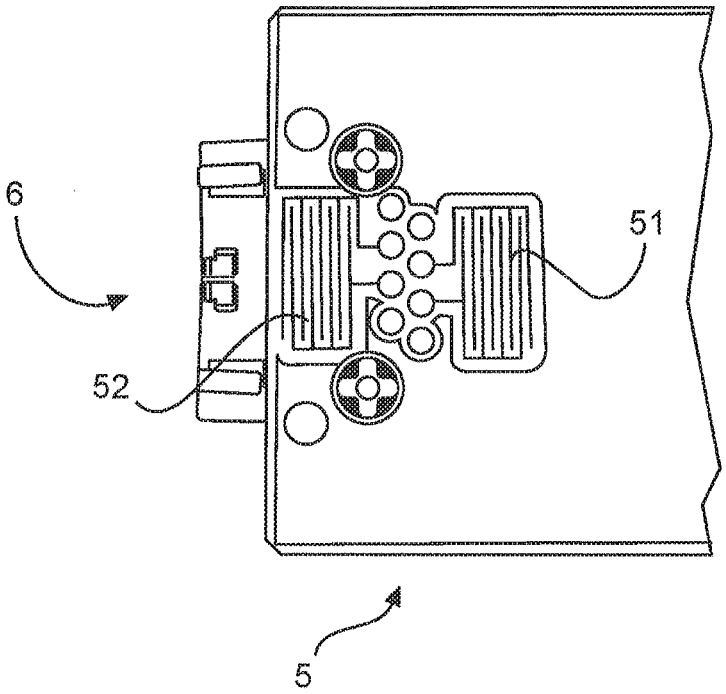

FIG. 9*b* shows the rear side of the printed circuit board 5, which has additionally applied thereto conductor path structures 51, 52 that already generate some rough crosstalk attenuation so that the above-mentioned capacitive crosstalk compensation by the compensation coating according to the invention constitutes some additional fine tuning through which the desired high data rate becomes possible.

A Plug-in Connector with Crosstalk Compensation

LIST OF REFERENCE NUMERALS

1, 1', 1", 1'" . . . Straight, offset, bridging, angled contact
11, 11', . . . Connection region
12, 12', . . . Holding region
13, 13', . . . Curved region
14, 14', . . . Contact region
15, 15', . . . End region
C, C1, C2, . . . Arrangement of uncrossed contacts
C', C1', C2', . . . Arrangement of crossed contacts
2, 3 First, second contact carriers
21, 22, 31, 32 First, second, third, fourth contact carrier parts
211, 211', . . . Fastening recesses
221, 222', . . . Fastening spigots
212, 212', 222, 222' Collar
215, 225 Interrupted webs
218, 228 Continuous webs
216, 226 First recess
217, 227 Second recess
311, 311', . . . Fastening recesses
321, 321', . . . Fastening spigots
313, 315, 323, 325 Interrupted webs
318, 328 Continuous webs
314, 319, 324, 329 Modified webs
316, 316', 326, 326' First recesses
317, 327, 327' Second Recesses
4, 4' Film
41, 41' Transverse web of the film
42, 42', 43, 43', 44, 44' Arms of the Film
5 Printed circuit board
51 Connections of the printed circuit board
6 Housing of the plug-in connector
A21, A22, A31, A32 Compensation coating
A215, A225, A315
A325, A215', . . . Conductive paths
A211, A212, A213,
A221, A222, A223 Coupling surface
A311, A312, A313,
A321, A322, A323 Coupling surface
A214, A224, A314, A324 Connection surfaces
K21, K21', . . . , K28, K28' Channels of the first contact carrier
K31, K31', . . . , K38, K38' Channels of the second contact carrier
V21, V22, V31, V32 Connection surfaces of the contact carrier parts
E21, E22, E31, E32 Indentations

The invention claimed is:

1. A plug-in connector, comprising an electrically insulating contact carrier and at least four electrically conductive contacts, wherein the contact carrier holds the contacts, wherein at least one coherent, electrically conductive compensation coating is applied onto at least one region of the contact carrier, wherein the coating is a compensation coating that is connected to one of the contacts in an electrically conductive manner and is capacitively coupled with at least one further one of the contacts, and wherein an electrically insulating layer is provided between the compensation coating and the at least one further contact, with which it is capacitively coupled.

2. The plug-in connector according to claim 1, wherein the compensation coating has a connection surface that is connected to the one of the contacts in an electrically conductive manner.

3. The plug-in connector according to claim 1, wherein the compensation coating has a connection surface that is connected to the one of the contacts in an electrically conductive manner, in that the compensation coating has at least one coupling surface that is capacitively coupled with the at least one further contact, and in that the compensation coating has one or more conductive paths which connect the connection surface to the at least one coupling surface in an electrically conductive manner.

4. The plug-in connector according to claim 1, wherein the compensation coating has a distance, on its at least one coupling surface, from the at least one further contact, with which it is capacitively coupled, the distance being smaller than 100 μm and larger than 0 μm.

5. The plug-in connector according to claim 1, wherein the electrically insulating layer is a varnish layer that is applied onto the compensation coating.

6. The plug-in connector according to 1, wherein the plug-in connector has eight contacts.

7. The plug-in connector according to claim 1, wherein the contact carrier is designed in one piece.

8. The plug-in connector according to claim 1, wherein the plug-in connector is an RJ45 socket.

9. The plug-in connector according to claim 1, wherein the contact carrier is designed in two parts, from two respectively associated contact carrier parts.

10. The plug-in connector according to claim 9, wherein the two contact carrier parts are adapted for being mounted to each other.

11. The plug-in connector according to claim 9, wherein the at least one coherent, electrically conductive compensation coating has been applied onto at least one of the two associated contact carrier parts.

12. The plug-in connector according to claim 1, wherein channels for receiving the contacts are provided in or on the contact carrier.

13. The plug-in connector according to claim 12, wherein the channels each have at their edges collars for an insertion of the contacts in a form-locking manner at least in certain regions.

14. The plug-in connector according to claim 12, wherein the coherent, electrically conductive compensation coating extends over a plurality of channels of the contact carrier or of the respective contact carrier part.

15. The plug-in connector according to 12, wherein one or more webs are provided in a plurality of channels.

16. The plug-in connector according to claim 15, wherein the compensation coating has a connection surface that is connected to the one of the contacts in an electrically conductive manner, in that the compensation coating has at least one coupling surface that is capacitively coupled with the at least one further contact, and in that the compensation coating has one or more conductive paths which connect the connection surface to the at least one coupling surface in an electrically conductive manner, and in that in at least one web, a first recess is provided, through which one of the conductive paths extends.

17. The plug-in connector according to claim 15, wherein between the compensation coating and the at least one further contact, with which it is capacitively coupled, an electrically insulating layer is provided, which is a film that is formed from an electrically insulating material, and in that the film is formed in one piece and in that in at least one web, a second recess is provided that is intended for the insertion of the integral film into a plurality of channels at the same time.

18. The plug-in connector according to claim 9, wherein between the compensation coating and the at least one further contact, with which it is capacitively coupled, in each case an electrically insulating layer is provided, which is a film that is formed from an electrically insulating material, and in that for each contact carrier part, one such integral film is provided.

19. The plug-in connector according to claim 18, wherein the compensation coating has at least one coupling surface that is capacitively coupled with the at least one further contact, and in that the respective film is provided, at least in certain regions, between the at least one further contact and the at least one coupling surface of the respective electrically conductive compensation coating.

20. The plug-in connector according to claim 18, wherein the compensation coating has at least one coupling surface that is capacitively coupled with the at least one further contact, and in that the film is formed from a dielectric material, through which the at least one further contact and the respective coupling surface are capacitively coupled.

21. The plug-in connector according to claim 18, wherein the electrically insulating layer is a film that is formed from an electrically insulating material, and in that in at least one of the contact carrier parts, an indentation is provided, into which the film can be inserted in a form-locking manner.

22. The plug-in connector according to claim 1, wherein the electrically insulating layer is a film that is formed from an electrically insulating material.

23. The plug-in connector according to claim 22, wherein the compensation coating has at least one coupling surface that is capacitively coupled with the at least one further contact, and in that the film is formed from a dielectric material, through which the at least one further contact and the respective coupling surface are capacitively coupled.

24. The plug-in connector according to claim 22, wherein the film has a thickness that is equal to or smaller than 100 μm.

25. The plug-in connector according to claim 22, wherein the film is designed to be E-shaped.

26. The plug-in connector according to claim 24, wherein the film has a thickness that is equal to or smaller than 50 μm.

27. The plug-in connector according to claim 26, wherein the film has a thickness that is equal to or smaller than 25 μm.

28. The plug-in connector according to claim 18, wherein the film has a thickness that is equal to or smaller than 100 μm.

29. The plug-in connector according to claim 28, wherein the film has a thickness that is equal to or smaller than 50 μm.

30. The plug-in connector according to claim 29, wherein the film has a thickness that is equal to or smaller than 25 μm.

31. The plug-in connector according to claim 1, wherein each of the contacts has at least one connection region, one holding region, one curved region and one contact region.

32. The plug-in connector according to claim 31, wherein the holding region directly follows the connection region and in that the curved region directly follows the holding region and in that the contact region directly follows the curved region.

33. The plug-in connector according to claim 31, wherein the contacts are held with their holding regions by the contact carrier.

34. The plug-in connector according to claim 31, wherein the compensation coating has a connection surface that is connected to the one of the contacts in an electrically conductive manner, and in that the compensation coating is connected with the holding region of the one contact in an electrically conductive manner.

35. The plug-in connector according to claim 31, wherein the compensation coating has a connection surface that is connected to the one of the contacts in an electrically conductive manner, and in that the compensation coating is capacitively coupled via its respective coupling surface with the holding region of the respective further contact.

36. The plug-in connector according to claim 35, wherein the respective coupling surface has a distance from the holding region of the associated further contact that is smaller than 100 μm and greater than 0 μm.

37. The plug-in connector according to claim 1, wherein the contact carrier is produced using a Moulded Interconnected Device ("MID") method.

38. The plug-in connector according to claim 37, wherein the MID method comprises a Laser Direct Structuring ("LDS") method.

39. The plug-in connector according to claim 37, wherein the MID method comprises a Two Component ("2C") method.

40. The plug-in connector according to claim 37, wherein the compensation coating is applied onto the contact carrier using the MID method.

41. A plug-in connector, comprising an electrically insulating contact carrier and at least four electrically conductive contacts, wherein the contact carrier holds the contacts and channels for receiving the contacts are provided in or on the contact carrier, wherein at least one coherent, electrically conductive compensation coating is applied onto at least one region of the contact carrier, wherein the coating is a compensation coating that is connected to one of the contacts in an electrically conductive manner and is capacitively coupled with at least one further one of the contacts, and wherein the coherent, electrically conductive compensation coating extends over a plurality of channels of the contact carrier or of the respective contact carrier part.

42. A plug-in connector, comprising an electrically insulating contact carrier and at least four electrically conductive contacts, wherein the contact carrier holds the contacts and channels for receiving the contacts are provided in or on the contact carrier, wherein at least one coherent, electrically conductive compensation coating is applied onto at least one region of the contact carrier, wherein the coating is a compensation coating that is connected to one of the contacts in an electrically conductive manner and is capacitively coupled with at least one further one of the contacts, wherein one or more webs are provided in the channels, and wherein the compensation coating has a connection surface that is connected to the one of the contacts in an electrically conductive manner, in that the compensation coating has at least one coupling surface that is capacitively coupled with the at least one further contact, and in that the compensation coating has one or more conductive paths which connect the connection surface to the at least one coupling surface in an electrically conductive manner, and in that in at least one web, a first recess is provided, through which one of the conductive paths extends.

43. A plug-in connector, comprising an electrically insulating contact carrier and at least four electrically conductive contacts, wherein the contact carrier holds the contacts, wherein at least one coherent, electrically conductive compensation coating is applied onto at least one region of the contact carrier, wherein the coating is a compensation coating that is connected to one of the contacts in an electrically conductive manner and is capacitively coupled with at least one further one of the contacts, wherein the contact carrier is designed in two parts, from two respectively associated contact carrier parts, and wherein between the compensation coating and the at least one further contact, with which it is capacitively coupled, in each case an electrically insulating layer is provided, which is a film that is formed from an electrically insulating material, and in that for each contact carrier part, one such integral film is provided.

44. A plug-in connector, comprising an electrically insulating contact carrier and at least four electrically conductive contacts, wherein the contact carrier holds the contacts and channels for receiving the contacts are provided in or on the contact carrier, wherein at least one coherent, electrically conductive compensation coating is applied onto at least one region of the contact carrier, wherein the coating is a compensation coating that is connected to one of the contacts in an electrically conductive manner and is capacitively coupled with at least one further one of the contacts, wherein one or more webs are provided in the channels, and wherein between the compensation coating and the at least one further contact, with which it is capacitively coupled, an electrically insulating layer is provided, which is a film that is formed from an electrically insulating material, and in that the film is formed in one piece and in that in at least one web, a second recess is provided that is intended for the insertion of the integral film into a plurality of channels at the same time.

* * * * *